US006729936B1

(12) United States Patent
Hori et al.

(10) Patent No.: US 6,729,936 B1
(45) Date of Patent: May 4, 2004

(54) APPARATUS FOR MEASURING DIMENSIONAL ERRORS OF ECCENTRIC CYLINDER BY UTILIZING MOVEMENT OF MEASURING MEMBER HELD IN CONTACT WITH SUCH ECCENTRIC CYLINDER

(75) Inventors: Nobumitsu Hori, Ichinomiya (JP); Yasuo Niino, Aichi-ken (JP); Toshiaki Naya, Aichi-ken (JP); Yuji Sasaki, Kariya (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/599,882

(22) Filed: Jun. 23, 2000

(30) Foreign Application Priority Data

Jun. 25, 1999 (JP) ..... 11-180421
Jun. 12, 2000 (JP) ..... 2000-174747

(51) Int. Cl.[7] ..... B24B 5/04
(52) U.S. Cl. ..... 451/8; 451/49
(58) Field of Search ..... 451/49, 8, 5, 11, 451/9, 10, 408; 33/555.1, 555.3, 549, 550, 551, 555

(56) References Cited

U.S. PATENT DOCUMENTS 2,603,043 A * 7/1952 Bontemps ..... 451/1
2,949,708 A * 8/1960 Wiatt et al. ..... 451/408
3,568,372 A * 3/1971 Asano et al. ..... 451/1
3,603,044 A * 9/1971 Price ..... 451/25
4,807,400 A * 2/1989 Corallo et al. ..... 451/25
5,150,545 A * 9/1992 Esteve ..... 451/25

FOREIGN PATENT DOCUMENTS

WO WO 97/12724 4/1997
WO WO 97/40434 10/1997

* cited by examiner

*Primary Examiner*—Robert A. Rose
(74) *Attorney, Agent, or Firm*—Oblon, Spivak, McClelland, Maier & Neustadt, P.C.

(57) ABSTRACT

An apparatus for measuring a circularity deviation of a cylinder of an object intended to be integrally rotated about a rotation axis, the cylinder being eccentric as either intended or not with the rotation axis, the apparatus includes a measuring device, a motion controlling mechanism, and a circularity deviation calculating device. The measuring device is adapted to measure a circumferential surface of the cylinder at each measuring point "p" thereon in a three-point contact method. The motion controlling mechanism is configured to permit the measuring device to be moved along a circumference of the cylinder, which circumference lays on a cross section of the cylinder perpendicular to the rotation axis, in contact with the circumferential surface of the cylinder, during rotation of the cylinder about the rotation axis. The circularity deviation calculating device is designed to calculate the circularity deviation of the cylinder, on the basis of a relative position "x" of the rotation axis relative to the apparatus for measuring the circularity deviation, a rotating angle $\phi$ of the cylinder about the rotation axis, and an output "y" of the measuring device.

25 Claims, 15 Drawing Sheets

M: GAUGE CYLINDER
$a_m$: STANDARD RADIUS (RADIUS OF GAUGE CYLINDER M)
$a_o$: AVERAGE RADIUS OF CYLINDRICAL WORKPIECE K
K: ECCENTRIC CYLINDER
p: MEASURING POINT

FIG. 11

| | DEGREE | | | | | | | | | | | | | | | |
|---|---|---|---|---|---|---|---|---|---|---|---|---|---|---|---|---|
| | 0 | 2 | 3 | 4 | 5 | 6 | 7 | 8 | 9 | 10 | 11 | 12 | 13 | 14 | 15 | 16 |
| α=60° | -1 | 2 | 3 | 2 | 0 | -1 | 0 | 2 | 3 | 2 | 0 | -1 | 0 | 2 | 3 | 2 |
| α=45° | -1.6 | 2.9 | 2.4 | 1 | -1.4 | -0.9 | 2 | 3.6 | 2 | -0.9 | -1.4 | 1 | 3.4 | 2.9 | 0 | -1.6 |

FIG. 13

| SENSOR | 0-DEGREE | 2-DEGREE | 3-DEGREE | 4-DEGREE | 5-DEGREE | 6-DEGREE | 7-DEGREE | 8-DEGREE | 9-DEGREE | 10-DEGREE |
|---|---|---|---|---|---|---|---|---|---|---|
| θ1=180° | -1.00 | 2.00 | 3.00 | 2.00 | 0.00 | -1.00 | 0.00 | 2.00 | 3.00 | 2.00 |
| θ2=45° | 2.73 | 0.95 | -1.41 | -0.63 | 1.99 | 0.73 | 1.88 | 0.95 | -.1.41 | -0.63 |

FIG. 16

MAGNIFICATIONS μ (α, n)
IN CASE OF RIDING GAUGE

| n \ α | 60° | 90° | 120° | 150° |
|---|---|---|---|---|
| 0 | -1.000 | -0.414 | -0.155 | -0.035 |
| 2 | 2.000 | 1.000 | 0.423 | 0.103 |
| 3 | 3.000 | 2.000 | 1.000 | 0.268 |
| 4 | 2.000 | 2.414 | 1.577 | 0.482 |
| 5 | 0.000 | 2.000 | 2.000 | 0.732 |
| 6 | -1.000 | 1.000 | 2.155 | 1.000 |
| 7 | 0.000 | 0.000 | 2.000 | 1.268 |
| 8 | 2.000 | -0.414 | 1.577 | 1.518 |
| 9 | 3.000 | 0.000 | 1.000 | 1.732 |
| 10 | 2.000 | 1.000 | 0.423 | 1.897 |
| 11 | 0.000 | 2.000 | 0.000 | 2.000 |
| 12 | -1.000 | 2.414 | -0.155 | 2.035 |

APPARATUS FOR MEASURING DIMENSIONAL ERRORS OF ECCENTRIC CYLINDER BY UTILIZING MOVEMENT OF MEASURING MEMBER HELD IN CONTACT WITH SUCH ECCENTRIC CYLINDER

BACKGROUND OF THE INVENTION

1. Field of the Invention

The present invention relates to technologies for measuring dimensional errors of a cylinder of an object to be integrally rotated about a rotation axis, the cylinder being eccentric with the rotation axis as planned or not.

2. Discussion of the Related Art

Conventionally, grinding a workpiece such as a crankpin of a crankshaft used in a gasoline engine, or a cam, is effected by precisely synchronizing a rotary motion of the workpiece about a rotation axis (referred to as the "C-axis" where appropriate), and a linear motion of a tool stand such as a grindstone stand in a direction (referred to as the "X-axis direction") perpendicular to the C-axis.

In the conventional art, by virtue of an advanced technology in the field associated with devices such as a servo-control device or a numerical control device, accuracies in the follow-up control, the synchronization or the movement of a machine has been improved.

However, it is the fact that only the improved accuracies in those areas above-mentioned, cannot adequately eliminate a profile error of a workpiece due to a change in rigidity of the workpiece, a change in a grinding force acting on the workpiece, and the like. Therefore, for a high precision in grinding, it is traditional that a workpiece is removed from a grinding machine before completion of a grinding process for the workpiece, and then geometrical errors of the workpiece (e.g., a circularity deviation of a crankpin and a profile of a cam) is measured. The measurements are used to obtain an amount of compensation for motion of the workpiece in a direction of the C- or X-axis, and subsequently the grinding for the same workpiece is initiated again under the new machining condition compensated accordingly.

In the field of measurement technology, there is generally well known a method employing a three-point contact type described in a technical paper titled "METHOD FOR MEASURING CIRCULARITY DEVIATION OF CYLINDRICAL WORKPIECE" (Japan Mechanical Engineering Association, Vol. 53, No. 376, May 1950), for example, as a method for accurately measuring a circularity deviation of a cylindrical workpiece. This technical paper explains a theoretical analysis for a case where a circularity deviation of a cylindrical workpiece is measured using a measuring device of a three-point contact method including a V-block type, a riding gauge type (wherein the V-shaped gauge is used so as to ride on the cylindrical workpiece) and a three-armed type. The paper teaches a method for quantitively obtaining an error of a cylindrical workpiece from a geometrically true circle in the manner shown by the following equations (1)–(6) and in FIGS. 14–16 in the case of the riding type, by way of example.

Variables, symbols, functions, etc. which will be used for explanation of the content of the technical paper, are defined as followed:

(Figure Symbols)

K: cylindrical workpiece such as a crankpin (i.e., a circumference of a cross sectional profile of the workpiece)

O: original point (i.e., one arbitrary point near the center of the circumference "K": a fixed point on the cross section of the workpiece)

C: arbitrary and stationary point defining an original line OC on a cross section of the workpiece)

M: gauge cylinder with a standard dimension of a radius am (i.e., a circumference of a cross section of the gauge cylinder)

a: point of contact of an end face of a measuring head of the measuring device of the three-point contact type (i.e., the riding gauge type) with the circumference "K"

b: one of two contact points at which two contact surfaces of the riding gauge contact the circumference "K"

c: the other of the two contact points mentioned above d: reference or datum point of the riding gauge (i.e., a center point of an opposing angle $\alpha$ mentioned below)

a': foot of perpendicular pendent from the original point O to an end face of the measuring head of the measuring device b': foot of perpendicular pendent from the original point O to one of the two contact surfaces of the riding gauge c': foot of perpendicular pendent from the original point O to the other of the two contact surfaces of the riding gauge (Variables)

$\theta$: angle relative to the original line OC $\alpha$: opposing angle between the two contact surfaces of the riding gauge which are opposed to each other not in parallel n: natural number (i.e., an index of the expansion of the Fourier series)

(Constants)

$a_0$: average radius of circumferences "K"

$c_n$: expansion coefficient of each term of the Fourier series for a radius $r(\theta)$ as mentioned below, when the expansion thereof is performed (obtained by the harmonic analysis)

$\phi_n$: initial phase of each term of the Fourier series for the radius $r(\theta)$ when the expansion thereof is performed (obtained by a harmonic analysis)

$a_m$: radius of the gauge cylinder "M"

$m_y$: average of outputs $y(\theta)$ of the measuring device, as mentioned below J: upper limit of the natural number n mentioned above (practically, "J" is enough when adopts about "50." In the technical paper mentioned above, the principle consideration is taken up to when J=12.).

N: the number of measuring times which the outputs $y(\theta)$ are actually measured (i.e., the sampling number of the measuring points)

(Functions)

$r(\theta)$: function for a radius of the circumference "K", and of the angle $\theta$ as an independent variable of the function $y(\theta)$: function for an output of the measuring device of the three-point contact type, and of the angle $\theta$ as an independent variable of the function $\mu(\alpha,n)$: function for a magnification of each component of a spectrum shown in the output $y(\theta)$, which magnifi cation serves to magnify a value of the term "$c_n \cos(n\theta+\phi_n)$" in the equation (3) mentioned below $$r(\theta)=a_0+{}_{n=1}\Sigma^{J} c_n \cos(n\theta+\phi_n \quad (1)$$

$$a_m\{1/\sin(\alpha/2)-1\}-y(\theta)=\{r(\theta+\pi/2-\alpha/2)+r(\theta-\pi/2+\alpha/2)\}/\{2\sin(\alpha/2)\}-r(\theta) \quad (2)$$

$$y(\theta)=(a_0-a_m)\cdot\{1-1/\sin(\alpha/2)\}+{}_{n=2}\Sigma^{J}\{\mu(\alpha, n)\, c_n \cos(n\theta+\phi_n)\} \quad (3)$$

$$\mu(\alpha, n)=1-\{\cos n(\pi/2-\alpha/2)\}/\sin(\alpha/2) \quad (4)$$

$$m_y = \int y(\theta)d\theta/2\pi \text{ (interval of integral: } 0 \leqq \theta \leqq 2\pi)$$
$$= (a_0 - a_m)\cdot\{1 - 1/\sin(\alpha/2)\}$$
$$= \left(\sum_{i=0}^{N-1} y_i\right)\Big/ N \quad (5)$$

$$a_0 = a_m + m_y/\{1 - 1/\sin(\alpha/2)\} \quad (6)$$

$$a_0=a_m+m_y/\{1-1/\sin(\alpha/2)\} \quad (6)$$

The expansion coefficients c, and initial phases $\phi_n$ for all the natural numbers n can be calculated when the outputs $y(\theta)$ are measured using a suitable opposing angle $\alpha$ or a suitable combination of opposing angles $\alpha$ in the three-point contact method. Therefore, it will be understood from the technical paper mentioned above that an error in profile of the actual cylinder K from a geometrically true circle (represented by the gauge cylinder "M") can be quantitively obtained as "$\delta r=r(\theta)-a_m$ according to the above equation (1). Wherein, the gauge cylinder "M" with a standard dimension of the radius $a_m$ is a desired cylinder.

It is noted that those definitions of variables, symbols, functions, etc. will be applicable to the following explanation.

The conventional technology mentioned above suffers from the following problems, and therefore, a general improvement in the art has been expected:

(Problem 1)

In a case where a workpiece is removed from a grinding machine before completion of a grinding process thereby, and where an accurate measurement of a profile of the workpiece (e.g., a circularity deviation of a cylinder of the workpiece) is then performed, there may arise a positional deviation between reference points set on the grinding machine and a measuring device for measuring the profile of the ground workpiece, respectively. Consequently, the positional deviation causes an inadequate degree of measuring accuracy of the workpiece, in many cases.

(Problem 2)

A process of setting the reference point for measurement of the workpiece, as mentioned above, requires a long time for adjusting the measuring condition, and the setting process is difficult to be automatized. As a result, productivity in a machining process such as a cylindrical grinding one fails to improve.

(Problem 3)

According to our proposal, there exists a case where an eccentric cylinder such as a crankpin aforementioned, which is a part of a workpiece, is scanned by a measuring device of a three-point contact type, with the workpiece still held rotatably by a machine, for measurement of a circularity deviation of the eccentric cylinder. In this case, the machine may be a grinding one in which a rotation of the workpiece about the C-axis and a feeding operation of a tool stand for a grindstone are synchronized with each other. In the proposed technology, the measuring device is attached to the grinding machine by a motion controlling mechanism for controlling a mechanical motion of the measuring device relative to the grinding machine, which mechanism is mainly constructed by a link mechanism. The measuring device is required to be moved along a circumference of the eccentric cylinder in contact with the circumference.

However, in this arrangement, freedom in motion of the link mentioned above is high. In addition, this arrangement is constructed to have a system of measurement in which the feeding operation of the tool stand, a change in attitude of the motion controlling mechanism, the measuring device, and the rotation of the eccentric cylinder about the C-axis are related to one another. As a result, the system of measurement also has freedom in motion thereof in directions of the C and X axes.

For the above reasons, it is not easy to accurately measure a phase angle (i.e., the aforementioned angle $\theta$) of the eccentric cylinder about its center, concurrently with the measurement of the circularity deviation (i.e., the aforementioned output $y(\theta)$).

There is a case where a crankshaft used in an engine having a plurality of cylinders is manufactured, for instance. In this case, unless the crankshaft is manufactured such that each of a plurality of crankpins thereof is accurate in position (i.e., an amount of eccentricity of each crankpin, and a phase of each crankpin about the rotating axis of the crankshaft) relative to a crank journal of the crankshaft, characteristics of the engine such as a compression ratio of a gas to be ignited and an ignition phase (i.e., ignition timing) can not be accurately obtained for each cylinder of the engine. Therefore, it is necessary to develop an apparatus for quickly and accurately measuring a position of an axis of an eccentric cylinder such as one of the crankpins, in order to efficiently manufacture a number of engines which are so high in performance as to adequately eliminate fuel consumption, vibration, noise, and the like.

The extremely accurate measurement of a position of an axis of an eccentric cylinder is adequately useful in measuring a circularity deviation of an eccentric cylinder, as well. Therefore, development .of means for quickly and accurately measuring the position of the axis of the eccentric cylinder has been expected.

BRIEF SUMMARY OF THE INVENTION

It is therefore a first object of the present invention to provide an apparatus for accurately and quickly measuring a circularity deviation of an eccentric cylinder having eccentricity as intended or not.

It is a second object of the present invention to provide an apparatus for machining an eccentric cylinder having eccentricity as intended or not, with an improved circularity of the eccentric cylinder and in a reduced time.

It is a third object of the present invention to provide an apparatus for accurately and quickly measuring a position of a center of an eccentric cylinder having eccentricity as intended or not.

It is a fourth object of the present invention to provide an apparatus for machining an eccentric cylinder having eccentricity as intended or not, with an improved accuracy of a position of a center of the eccentric cylinder and in a reduced time.

It is a fifth object of the present invention to provide an apparatus for machining an eccentric cylinder having eccentricity as intended or not, with an improved circularity of the eccentric cylinder and an improved accuracy of a position of a center of the eccentric cylinder, and in a reduced time.

These objects indicated above may be achieved according to any one of the following modes of this invention. Each of these modes of the invention is numbered like the appended claims, and depends from the other mode or modes, where appropriate. This type of explanation about the present invention is for better understanding of some ones of a plurality of technical features and a plurality of combinations thereof disclosed in this specification, and dose not mean that the plurality of technical features and the plurality of combinations in this specification are interpreted to encompass only the following modes of this invention:

(1) An apparatus for measuring a circularity deviation of a cylinder of an object intended to be integrally rotated about a rotation axis, the cylinder being eccentric as either intended or not with the rotation axis, the apparatus comprising:

a first measuring device measuring a circumferential surface of the cylinder at each measuring point "p" thereon in a three-point contact method;

a motion controlling mechanism permitting the first measuring device to be moved along a circumference of the cylinder, which circumference lays on a cross section of the cylinder perpendicular to the rotation axis, in contact with the circumferential surface of the cylinder, during rotation of the cylinder about the rotation axis;

a circularity deviation calculating device calculating the circularity deviation of the cylinder, on the basis of a relative position "x" of the rotation axis relative to the apparatus for measuring the circularity deviation, a rotating angle $\phi$ of the cylinder about the rotation axis, and an output "y" of the first measuring device.

The apparatus according to this mode (1) would achieve the first object of the present invention mentioned above, which is to say, to provide an apparatus for accurately and quickly measuring a circularity deviation of an eccentric cylinder having eccentricity as intended or not.

In the apparatus according to this mode (1) the term "rotation axis" may be interpreted to mean an axis about which the cylinder is rotatable continuously in one direction, or mean an axis about which the cylinder is rotatable alternately in opposite directions. The selection of the definitions about the term "rotation axis" would not affect the operation and results of the apparatus according to this mode (1), as mentioned above. It is noted that this interpretation about the term "rotation axis" is applicable to the following modes.

In the apparatus according to this mode (1), the relative position "x", rotating angle $\phi$, and output "y" which are to be used for calculating the circularity deviation for each angle $\theta$ (e.g., each measuring point "p") of the cylinder may be related to one another in that they are established together with relation to each angle $\theta$.

(2) The apparatus according to the above mode (1), wherein the object is a workpiece, a circumferential surface of which is machined by a machine contacting a tool attached to a tool stand of the machine, with the circumferential surface of the workpiece for machining, the measurement of the circularity deviation by the apparatus for measuring the circularity deviation is performed without removal of the workpiece from the machine.

In the apparatus according to this mode (2), a circularity deviation of an eccentric cylinder formed integrally on a workpiece, which is held rotatably about a rotation axis within a machine such as a grinding machine, can be measured without removal of the workpiece out of the machine. In other words, it is unnecessary to remove the workpiece out, during the measurement of the circularity deviation of the eccentric cylinder. As a result, the apparatus according to this mode (2) would leave out a removing and installing process of a workpiece from and on a machine for the measurement, and at the same time, would not arise a deviation of a set position of the workpiece between during machining process and during measuring of the circularity deviation. For this reason, a circularity deviation of an eccentric cylinder can be measured in a reduced time.

(3) The apparatus according to the above mode (2), wherein the machine moves the cylinder and the tool stand relatively to each other in a feeding direction perpendicular to the rotation axis, thereby permitting the tool to follow the cylinder during rotation of the cylinder about the rotation axis, resulting in a change in the relative position "x".

(4) The apparatus according to any one of the above modes (1)–(3), wherein the circularity deviation calculating device comprises:

a second measuring device measuring the relative position "x";

a third measuring device measuring the rotating angle $\phi$; and circularity deviation calculating means calculating the circularity deviation, on the basis of the measured relative position "x" and rotating angle $\phi$, and the output "y" of the first measuring device.

(5) The apparatus according to any one of the above modes (1)–(4), wherein the motion controlling mechanism is adapted to have a geometrical configuration permitting a relationship among the relative position "x", the rotating angle $\phi$, and an angle $\theta$ of the cylinder about an original point O defined to be located at or near a center of the cylinder, to be independent of a change in an attitude of the motion controlling mechanism, which attitude results from rotation of the cylinder.

(6) The apparatus according to the above mode (5), wherein the motion controlling mechanism comprises:

a first arm coupled with an stationary member, pivotable about a first pivoting axis offset in parallel from the rotation axis;

a second arm coupled with a free end of the first arm, pivotable about a second pivoting axis offset in parallel from the rotation axis, the second arm carrying at a free end thereof the first measuring device.

(7) The apparatus according to the above mode (6), wherein the second arm is configured to have a first sub-arm extending from the second pivoting axis, and a second sub-arm secured to the first sub-arm so as to form a predetermined fixed angle $\zeta$ therebetween, the second sub-arm carrying at a free end thereof the first measuring device.

(8) The apparatus according to any one of the above modes (1)–(7), wherein the circularity deviation calculating device comprises first variable-transforming means expressing a position of the each measuring point "p" on the circumferential surface of the cylinder, according to a system of 2-dimensional polar coordinates formulated on a coordinate plane which is defined by an original point O predetermined to be located at or near a center of the circumference of the cylinder, and an original line OC predetermined to extend from the original point O and which is fixed to the circumference of the cylinder, using a distance "r" from the original point O and an angle $\theta$ relative to the original line OC, the circularity deviation calculating device further obtains the output "y" measured by the first measuring device at the each measuring point "p" in the form of a function $y(\theta)$ of the angle $\theta$, by utilizing a first variable-transformation for transforming the relative position "x" and rotating angle $\phi$ obtained when the output "y" is measured by the first measuring device at the each measuring point "p", into the angle $\theta$.

(9) The apparatus according to the above mode (8), wherein the first variable-transformation is a variable-transformation "$\theta=f(\phi, x, \Lambda)$" for transforming the relative position "x" and rotating angle $\phi$ obtained when the output "y" is measured by the first measuring device at the each measuring point "p", into the angle $\theta$, by utilizing a predetermined group of parameters A for defining an attitude of the motion controlling mechanism.

(10) The apparatus according to the above mode (9), wherein the predetermined group of parameters $\Lambda$ includes at least one of a length of at least one of a plurality of constituents of the motion controlling mechanism, and a magnitude of at least one of angles each of which is formed between ones of the plurality of constituents adjacent to each other.

(11) The apparatus according to the above mode (9) or (10), wherein the motion controlling mechanism comprises:

a first arm coupled with an stationary member, pivotable about a first pivoting axis offset in parallel from the rotation axis;

a second arm coupled with a free end of the first arm, pivotable about a second pivoting axis offset in parallel from the rotation axis, the second arm configured to have a first sub-arm extending from the second pivoting axis; and a second sub-arm secured to the first sub-arm so as to form a predetermined fixed angle $\zeta$ therebetween, the second sub-arm carrying at a free end thereof the first measuring device, the predetermined group of parameters $\Lambda$ includes at least one of a deviation "D" of the first pivoting axis from a reference axis of the stationary member in a horizontal direction; a height "H" of the first pivoting axis from the reference line; a radius "R" of a circular locus followed by the center of the cylinder during rotation thereof about the rotation axis; a length "$L_1$" of the first arm; a length "$L_{21}$" of the first sub-arm; a length "$L_{22}$" of the second sub-arm; and the predetermined fixed angle $\zeta$.

(12) The apparatus according to the above mode (11), wherein the object is a workpiece, a circumferential surface of which is to be machined by a machine, the machine is a cylindrical grinding machine grinding the circumferential surface of the workpiece by holding a tool attached to a tool stand of the cylindrical grinding machine, in contact with the circumferential surface of the cylinder, while rotating the tool about the rotation axis "W", the tool stand functioning as the stationary member, the rotation axis "W" functioning as the reference axis of the stationary member.

(13) The apparatus according to any one of the above modes (8)–(12), wherein the circularity deviation calculating device further comprises:

distance obtaining means obtaining from the function $y(\theta)$, by utilizing a technique for analysis such as a harmonic analysis the distance "r" from the original point O, of the each measuring point "p" on the circumferential surface of the cylinder, in the form of a function $r(\theta)$ of the angle $\theta$;

second variable-transforming means transforming the function $r(\theta)$ into a function $r(\phi)$ of the rotating angle $\phi$, using a second variable-transformation for transforming the angle $\theta$ and relative position "x" obtained at the each measuring point "p" into the rotating angle $\phi$; and compensatory amount obtaining means obtaining an amount $\delta x$ by which the relative position "x" is to be compensated for permitting the function $r(\phi)$ to become closer to a target radius $a_m$ of the cylinder as a result of machining of the circumferential surface of the cylinder, in the form of a function $\delta x(\phi)$ of the rotating angle $\phi$.

(14) The apparatus according to the above mode (13), wherein the second variable-transformation is regarded as an inverse-transformation of the first variable-transformation in terms of a relationship between the rotating angle $\phi$ and angle $\theta$.

(15) The apparatus according to any one of the above modes (1)–(14), wherein the first measuring device includes a plurality of measuring members, each measuring member intended to be in contact with the circumferential surface of the cylinder on two contact surfaces of the each measuring member, the two contact surfaces of the each measuring member being opposed to each other with an opposing angle $\alpha$ therebetween, which angle $\alpha$ is unequal to 180 degrees and which is different from opposing angles $\alpha$ of other ones of the plurality of measuring members.

(16) The apparatus according to the above mode (15), wherein the plurality of measuring members are arranged in a common plane bisecting the opposing angles $\alpha$ of the plurality of measuring members, the first measuring device further includes a sensor to be used commonly with the plurality of measuring members, which sensor measures the cylinder in one measuring direction on the common plane.

(17) The apparatus according to any one of the above modes (1)–(16), wherein the first measuring device includes a plurality of sensors each measuring the cylinder, such that the plurality of sensors are arranged at different phase angles 73 about an original point O defined to be located at or near a center of the circumference of the cylinder.

(18) The apparatus according to the above mode (17), wherein at least one of the plurality of sensors includes an adjusting mechanism permitting a position or an orientation of the measuring direction of the at least one sensor, to be changed on the basis of an average radius $a_0$ of the cylinder, thereby enabling an adjustment in a position of a point of intersection of a plurality of lines extending from the respective sensors in the corresponding measuring directions.

(19) The apparatus according to any one of the above modes (1)–(18), further comprising:

a motion sensor detecting a motion parameter $\xi$ related to a mechanical motion of the motion controlling mechanism; and parameter correcting means correcting at least one of constants belonging to the predetermined group of parameters $\Lambda$, which constant is necessary to be considered for replacement, repair or adjustment of the first measuring device, the correction being effected on the basis of a target radius am of the cylinder, and the motion parameter $\xi$ detected by the motion sensor in a state where a gauge cylinder is contacted with the first measuring device, an actual radius of the gauge cylinder not being eccentric with the rotation axis, which actual radius is equal to the target radius $a_m$.

(20) The apparatus according to any one of the above modes (1)–(19), further comprising:

a motion sensor detecting a motion parameter $\xi$ related to a mechanical motion of the motion controlling mechanism; and original point position measuring means measuring a position of an original point O defined to be fixedly located at or near a center of the cylinder, which position is defined relative to the rotation axis, on the basis of the relative position "x" or a value related thereto, the rotating angle $\phi$ or a value related thereto, and the motion parameter $\xi$ or a value related thereto.

In the apparatus according to this mode (20), the use of a motion parameter $\xi$ related to a mechanical motion of the motion controlling mechanism enables a more accurate detection (i.e., measurement) of coordinates of a center (i.e., a position of an axis of an eccentric cylinder) of an eccentric cylinder such as a crankpin.

(21) The apparatus according to the above mode (20), wherein the motion sensor includes at least one of a pivoting angle sensor detecting a pivoting angle of an arm of the motion controlling mechanism, which arm functions to produce the mechanical motion of the motion controlling mechanism by a pivoting motion of the arm, and an arm length sensor detecting a length of the arm.

(22) A cylindrical grinding machine comprising:

an apparatus for measuring a circularity deviation defined in any one of the above modes (1)–(21);

a grinding device grinding a cylinder defined in the above mode (1), by holding a tool attached to a tool stand of the cylindrical grinding machine, in contact with a circumferential surface of the cylinder, while rotating the tool about a rotation axis "W"; and synchronization controlling means synchronously controlling a relative position "x" and rotating angle $\phi$ defined in claim 1, during operation of the grinding device, and controlling the synchronization of the relative position "x" and rotating angle $\phi$, on the basis of a result produced by operation of the apparatus for measuring the circularity deviation.

The apparatus according to this mode (22) would achieve the second object of the present invention, which is to say, to provide an apparatus for machining an eccentric cylinder having eccentricity as intended or not, with an improved circularity of the eccentric cylinder and in a reduced time.

The present apparatus may be used such that an accurate measurement of the circularity deviation of the eccentric cylinder of a workpiece, and an accurate machining process of the workpiece are performed without removal of the workpiece from a machine for machining the workpiece.

(23) A apparatus for measuring a center position of a cylinder of an object intended to be integrally rotated about a rotation axis, the cylinder being eccentric as either intended or not with the rotation axis, the apparatus comprising:

a contact member intended to be in contact with a circumferential surface of the cylinder;

a motion controlling mechanism permitting the contact member to be moved in a circumferential direction of the cylinder in contact with the circumferential surface of the cylinder, during rotation of the cylinder about the rotation axis;

a motion sensor detecting a motion parameter $\xi$ related to a mechanical motion of the motion controlling mechanism; and original point position calculating device calculating a position of an original point O defined to be fixedly located at or near a center of a circumference of the cylinder, as the center position of the cylinder, which position is defined relative to the rotation axis, the calculation being effected on the basis of a relative position "x" of the rotation axis relative to the apparatus for measuring the center position of the cylinder or a value related thereto, a rotating angle $\phi$ of the cylinder about the rotation axis or a value related thereto, and the motion parameter $\xi$ or a value related thereto.

In the apparatus according to this mode (23), the use of a motion parameter $\xi$ related to a mechanical motion of the motion controlling mechanism enables a more accurate detection (i.e., measurement) of coordinates of a center (i.e., a position of an axis of an eccentric cylinder) of an eccentric cylinder such as a crankpin.

Thus, the apparatus according to this mode (23) would achieve the third object of the present invention, which is to say, to provide an apparatus for accurately and quickly measuring a position of a center of an eccentric cylinder having eccentricity as intended or not.

(24) The apparatus according to the above mode (23), wherein the object is a workpiece, a circumferential surface of which is machined by a machine holding a tool attached to a tool stand of the machine, in contact with the circumferential surface of the workpiece for machining, the measurement of the center position by the apparatus for measuring the center position is performed without removal of the workpiece from the machine.

(25) The apparatus according to the above mode (24), wherein the machine moves the cylinder and the tool stand relatively to each other in a feeding direction perpendicular to the rotation axis, thereby permitting the tool to follow the cylinder during rotation of the cylinder about the rotation axis, resulting in a change in the relative position "x".

(26) The apparatus according to any one of the above modes (23)–(25), wherein the original point position calculating device comprises:

a measuring device measuring the relative position "x";

a measuring device measuring the rotating angle $\phi$; and original point position calculating means calculating the position of the original point O, on the basis of the measured relative position "x" and rotating angle $\phi$, and the motion parameter $\xi$ detected by the motion sensor.

(27) The apparatus according to any one of the above modes (23)–(26), wherein the motion sensor includes at least one of a pivoting angle sensor detecting a pivoting angle of an arm of the motion controlling mechanism, which arm functions to produce the mechanical motion of the motion controlling mechanism by a pivoting motion of the arm, and an arm length sensor detecting a length of the arm.

(28) The apparatus according to any one of the above modes (23)–(27), wherein the original point position calculating device obtains a phase angle error $\Delta\phi$ defined as a deviation of an actual value from an ideal value of the rotating angle $\phi$, performs correction using the obtained phase angle error $\Delta\phi$ for the actual value of the rotating angle $\phi$, and obtains an amount "R" by which the original point O is offset from the rotation axis, by means of measurement or calculation, thereby performing measurement or correction of the position of the original point O relative to the rotation axis.

(29) The apparatus according to any one of the above modes (23)–(28), further comprising parameter correcting means correcting at least one of constants belonging to a predetermined group of parameters $\Lambda$ defining an attitude of the motion controlling mechanism, which constant is necessary to be considered for replacement, repair or adjustment of the first measuring device, the correction being effected on the basis of a target radius $a_m$ of the cylinder, and the motion parameter $\xi$ detected by the motion sensor in a state where a gauge cylinder is contacted with the contact member, an actual radius of the gauge cylinder not being eccentric with the rotation axis, which actual radius is equal to the target radius $a_m$.

(30) The apparatus according to any one of the above modes (23)–(29), further comprising an apparatus for measuring a circularity deviation defined in any one of the above modes (1)–(22).

(31) A cylindrical grinding machine comprising:

an apparatus for measuring a center position defined in any one of the above modes (23)–(29);

a grinding device grinding a cylinder defined in the above mode (23) by holding a tool attached to a tool stand of the cylindrical grinding machine, in contact with a circumferential surface of the cylinder, while rotating the tool about a rotation axis "W"; and synchronization controlling means synchronously controlling a relative position "x" and rotating angle $\phi$ defined in the above mode (23) during operation of the grinding device, and controlling the synchronization of the relative position "x" and rotating angle $\phi$, on the basis of a result produced by operation of the apparatus for measuring the center position.

The apparatus according to this mode (31) would achieve the fourth object of the present invention, which is to say, to provide an apparatus for machining an eccentric cylinder having eccentricity as intended or not, with an improved accuracy of a position of a center of the eccentric cylinder and in a reduced time.

In addition, the apparatus according to this mode (31) would enable manufacture of an eccentric cylinder with an accurate eccentricity thereof relative to the rotation axis and an accurate phase thereof about the rotation axis.

The result to be provided by the apparatus according to this mode (31) will be described by way of an example in which a crankpin of a crankshaft used in an engine having a plurality of cylinders. In this example, each crankpin can be manufactured such that each crankpin is extremely accurate in position. Therefore, events such as an equalization of compression ratios of a gas to be ignited among the plurality of cylinders, and optimization of an ignition timing for each cylinder can be performed with an extremely high degree of accuracy, with the result that engines can be manufactured so as to have such a high performance that fuel consumption, noise, vibration, and otherwise are well restricted.

(32) A cylindrical grinding machine comprising:

an apparatus for measuring a circularity deviation defined in any one of the above modes (1)–(22);

an apparatus for measuring a center position defined in any one of the above modes (23)–(29);

a grinding device grinding a cylinder defined in the above mode (1) or (23), by holding a tool attached to a tool stand of the cylindrical grinding machine, in contact with a circumferential surface of the cylinder, while rotating the tool about a rotation axis "W"; and synchronization controlling means synchronously controlling a relative position "x" and rotating angle $\phi$ defined in the above mode (1) or (23), during operation of the grinding device, and controlling the synchronization of the relative position "x" and rotating angle $\phi$, on the basis of results produced by operation of the apparatus for measuring the circularity deviation and the apparatus for measuring the center position.

The apparatus according to this mode (32) would achieve the fifth object of the present invention, which is to say, to provide an apparatus for machining an eccentric cylinder having eccentricity as intended or not, with an improved circularity of the eccentric cylinder and an improved accuracy of a position of a center of the eccentric cylinder, and in a reduced time.

(33) The apparatus according to the above mode (32), wherein a non-exclusive combination of the measurement or correction of the position of the original point calculated by the original point position calculating device, the calculation of the circularity deviation by the circularity deviation calculation device, and the operation of the synchronization controlling means is effected sequentially a required number of times, thereby permitting a profile of a cross section of the cylinder to gradually approach a geometrically true circle.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 11 is a table illustrating magnifications for respective spectrum components of an error of an actual circle from a geometrically true circle, which error is measured by the measuring device 700 of FIGS. 10A and 10B;

FIG. 13 is a table illustrating magnifications for respective spectrum components of an error of an actual circle from a geometrically true circle, which error is measured by the measuring device 800 of FIG. 12A;

FIG. 16 is a table illustrating magnifications for respective spectrum components of an error of an actual circle from a geometrically true circle, which error is measured by a riding gauge.

DETAILED DESCRIPTION OF THE INVENTION

Several presently preferred embodiments of the invention will be described in detail by reference to the drawings in which like numerals are used to indicate like elements throughout.

(First Embodiment)

Figure 1:
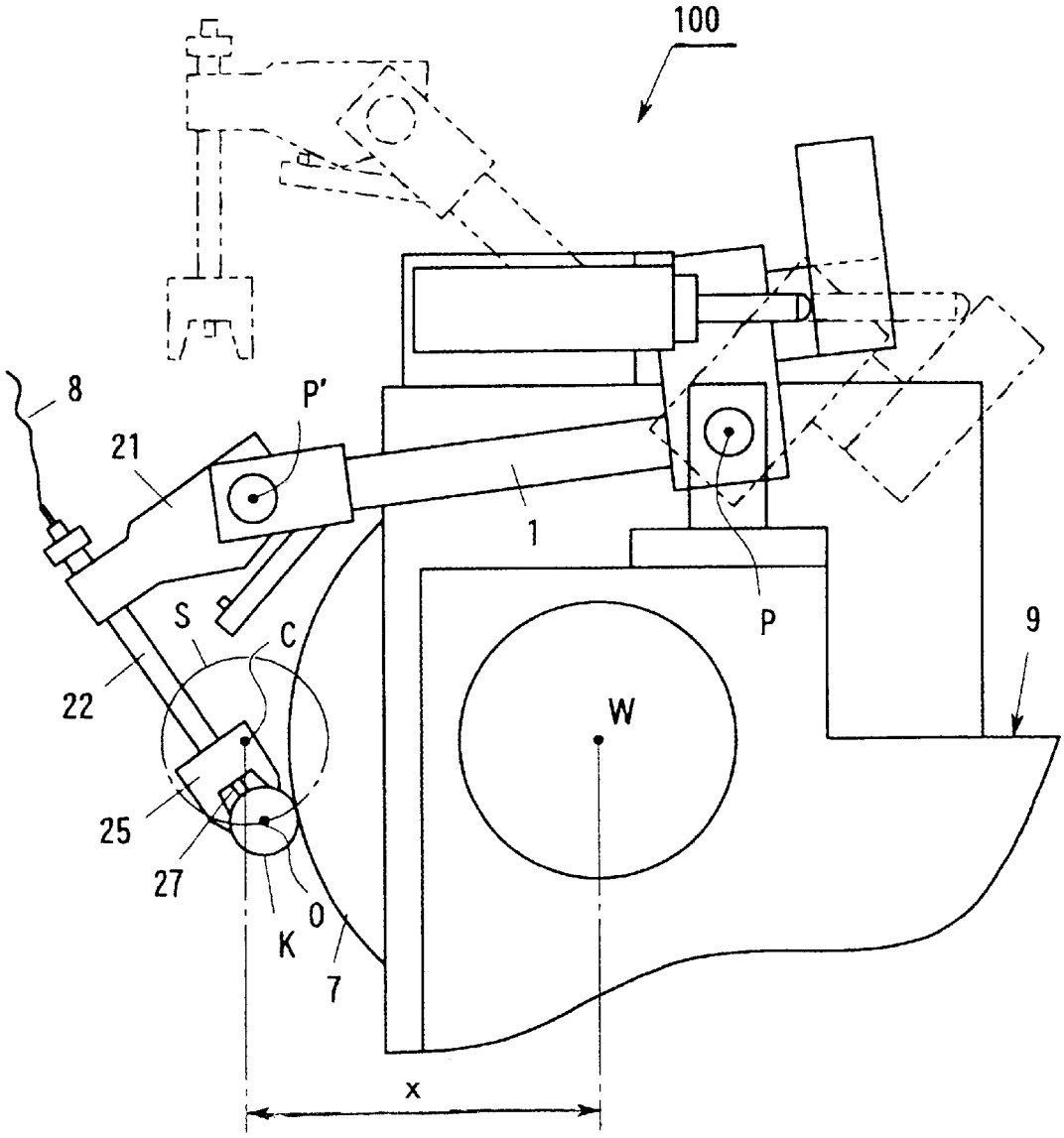
FIG. 1 is a side elevation view generally illustrating a cylindrical grinding machine 100 constructed according to a first embodiment of this invention.

Referring first to the side elevation view of FIG. 1, there will be generally illustrated a cylindrical grinding machine 100 according to a first embodiment of the present invention. The cylindrical grinding machine 100 is provided with a grindstone stand 9 (as one example of a tool stand) to which a disc-like grindstone 7 (e.g., a grinding wheel) is attached. The grindstone 7 is supported in the cylindrical grinding machine 100 such that the grindstone 7 is rotatable about a rotation axis X (as shown in the form of a point W in FIG. 1). In Fig. Symbol "K" denotes a circumference of a cross section of a crankpin cooperating with a crank journal to form a crankshaft for an engine. The center O of the circumference "K" is located within the crank journal. The crank journal is supported by a support (as not shown) of the cylindrical grinding machine 10 such that the center O is rotatable along a circular orbit S centered on a C-axis (as shown in the form of a point C in FIG. 1) of the cylindrical grinding machine 10. A distance "x" between the C- and W-axes is controllable by an NC servomechanism of the cylindrical grinding machine 10.

Reference numeral 27 denotes a measuring head of a measuring device 25 of a three-point contact type (i.e., a riding gauge type). The riding gauge 25 is supported by a lower sub-arm 22 such that the gauge 25 is slidable along the circumference "K" in contact with an outer circumferential surface of the crankpin (i.e., an eccentric cylinder). A first pivot P, which is secured to the grindstone stand 9, a first arm 1, a second pivot P', an upper sub-arm 21, the lower sub-arm 22, and the like cooperate to constitute sliding means for sliding the measuring device 25. The sliding means permits the measuring device 25 to be smoothly moved along the circumference "K" of the crankpin, which circumference is an outer circumference on a lateral surface of the crankpin, in contact with the circumference "K". As is apparent from the above, the sliding means functions as a motion control mechanism for the measuring device 25 in the present embodiment.

Although the contact of the measuring device 25 with the outer circumferential surface of the crankpin is mainly maintained by gravity acting on the measuring device 25, the sliding means may be modified so as to utilize biasing means such as a spring or a magnet for biasing the measuring device 25 to beheld in contact with the outer circumferential surface of the crankpin.

In FIG. 1, reference numeral 8 denotes a wire permitting the measuring device 25 to output signals indicative of measurements about the crankpin.

Figure 2:
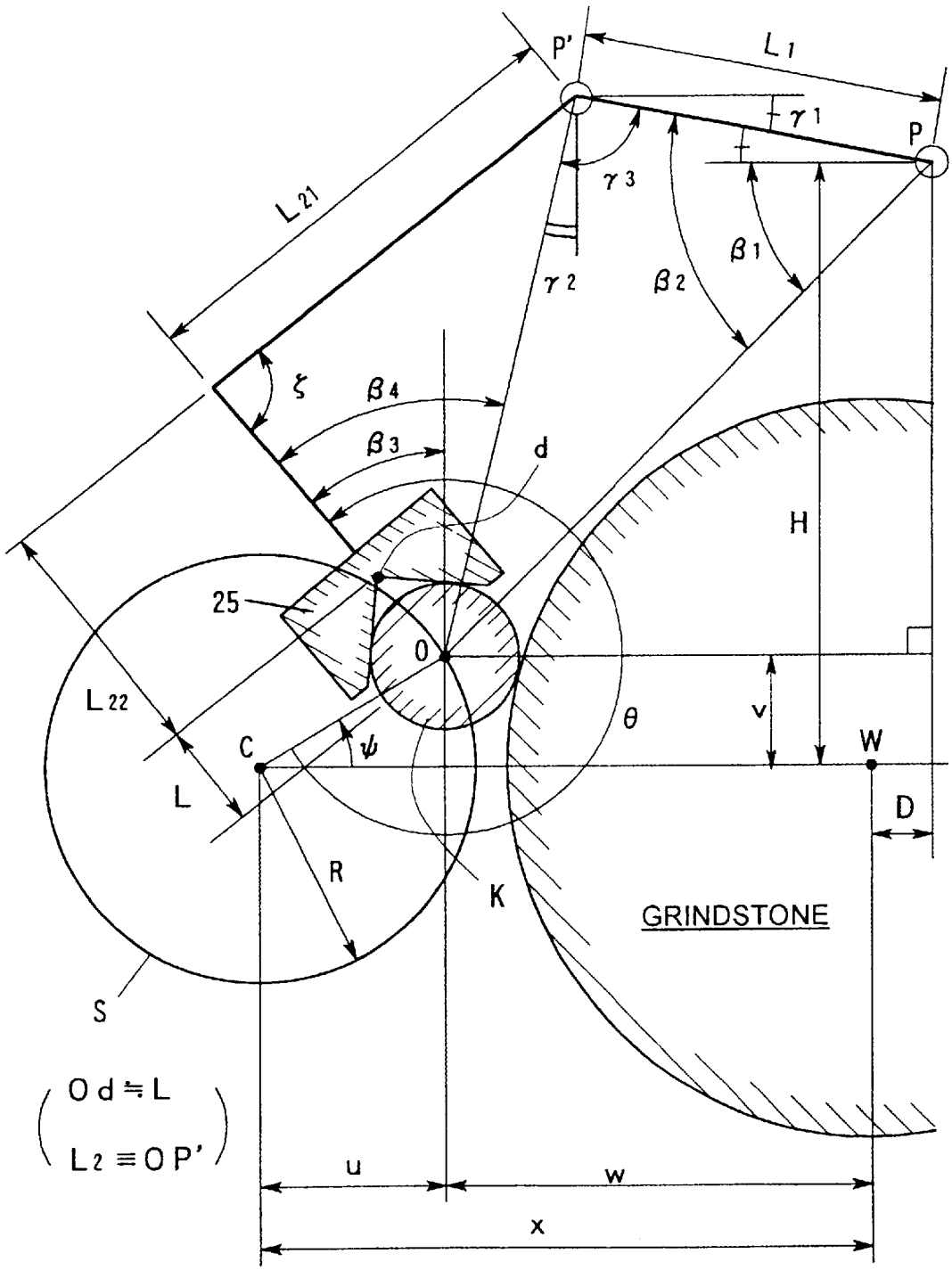
FIG. 2 is a view for explaining variable-transformation means associated with the first embodiment of this invention.

Referring next to FIG. 2, there will be explained operation of variable-transformation means according to the presently embodiment, for transforming a function y(ϕ, x) into a function y(θ). FIG. 2 schematically represents a motion of the sliding means (a shown in FIG. 1) on a plane transversally intersecting the crankpin. It is noted that "θ" is defined as an angle about the point O (the center of the crankpin) and measured from an original line OC to the centerline (see FIG. 3) of the measuring device 25. The angle θ is an angular coordinate of a measuring point p (see FIG. 3) on the circumference "K" of the crankpin. Other symbols including "y", "ϕ" and "x" are defined as follows:

(Measurement Variables)

y: output of the measuring device 25 of the three-point contact type x: distance between the C- and W-axes (recorded as a value when the output "y" is measured)

ϕ: rotating angle ∠WCO of the crankpin about the C-axis (recorded as a value when the output "y" is measured)

This variable transformation is achieved by a determined function f satisfying an equation "θ=f(ϕ,x,Λ)." The determination of the function f would permit the output y (i.e., the value of the function y(ϕ,x)) of the measuring device 25 of the three-point contact type to be treated as the function y(θ) formulated by an independent variable thereof representing the angle θ. In the above equation, "Λ" means a group (i.e., a group of sliding mechanism parameters) of constants representing the structure relating to the attitude of the sliding means mentioned above. By considering that the group Λ is one consisting of constants, symbol "Λ" will be left out in referring to the group where appropriate.

There will be described a technique for specifically determining the function f.

In addition to the aforementioned symbols, the following symbols (representing constants) will be used in the explanation of FIG. 2, for example. The function f can be determined by the use of the above-mentioned constants representing the structure associated with the attitude of the sliding means, which constants include ones for defining dimensions such as lengths or angles of parts of the sliding means or a machine. In the presently preferred embodiment, the group Λ includes as elements the following seven constants:

D: deviation of the first pivot P from the rotation axis W in the horizontal direction (i.e., the direction of the X-axis)

H: height of the first pivot P from the rotation axis W

R: radius of the circular orbit followed by the center of the eccentric cylinder during rotation thereof about the C-axis $L_1$: length of the first arm 1

$L_{21}$: length of the upper sub-arm 21

$L_{22}$: length of the lower sub-arm 22

ξ: predetermined fixed angle between the upper and lower sub-arms 21, 22

Figure 3:
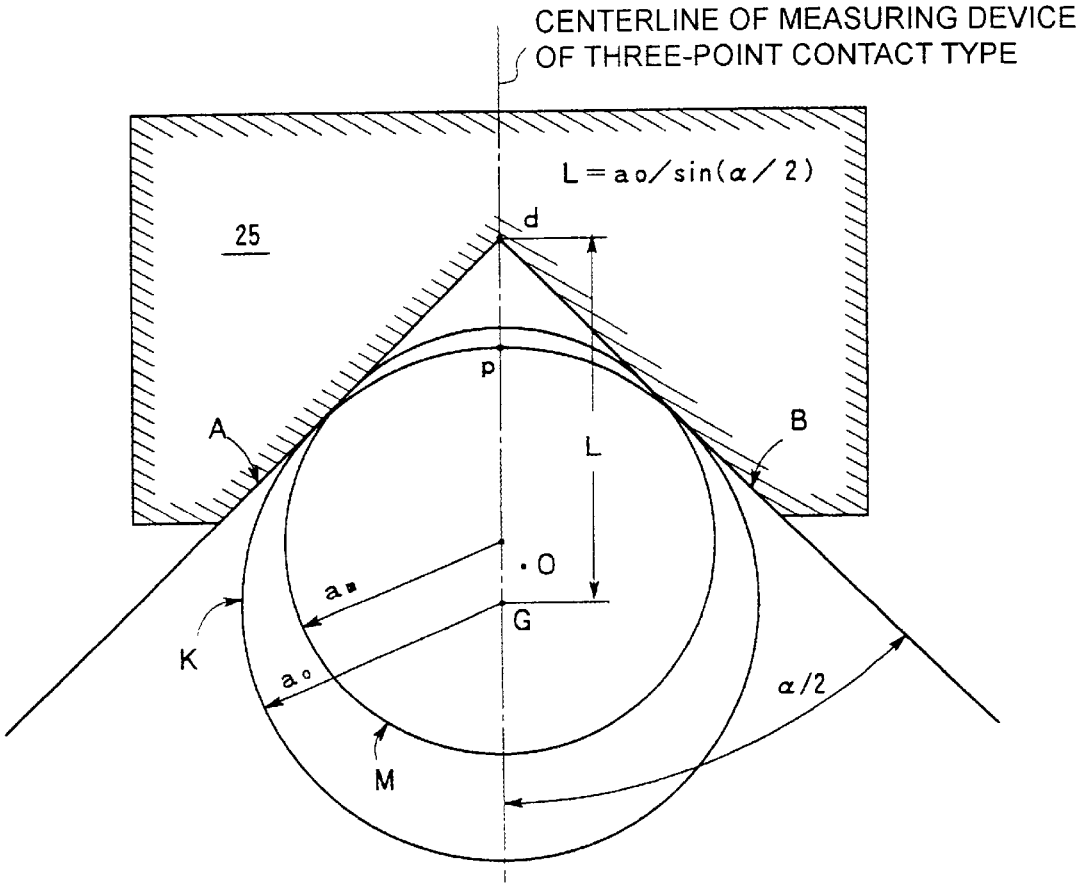
FIG. 3 is a sectional view illustrating a positional relationship between a cylinder having a cross section whose outline is a geometrically true circle having a radius $a_0$, and a V-gauge sitting on the cylinder.

Referring next to FIG. 3, there will be described a positional relationship between an ideal cylinder and the riding gauge 25 (i.e., a V-gauge) sitting on the ideal cylinder. The ideal cylinder has a cross section whose outline is a geometrically true circle having a radius $a_0$. In FIG. 3, a point G represents a center of the geometrically true circle. With the ideal circle being contacted with the V-gauge 25 on contact surfaces A, B thereof at right angles, a distance "L" between the center G of the ideal circle and a datum point "d" of the V-gauge 25 is obtained according to the following equation (7).

$$L=G\ d=a_0/\sin(\alpha/2) \tag{7}$$

Thus, the point G is a fixed point with relation to the point "d" and the contact surfaces A, B, provided that the radius $a_0$ is held constant.

On the other hand, since the circumference "K" of the crankpin on which actual measuring points p is located is not an ideal circle, the center O of the circumference "K" cannot be uniquely. In other words, precisely, the original point O fixed to a cross section of the crankpin is not more than one fixed point which is determined such that the original point O is located near the center of the circumference "K" and such that the original point O meets the relationship with the point C, as defined as "OC=R, ∠WCO=ϕ." Therefore, the point G and O do not coincide with each other, in general. In addition, since a distance OG between those two points varies depending upon the angle θ, the distance OG can be regarded as a function OG(θ) whose variable represents the angle θ.

However, in the case of the establishment of the following equation (8), the following equation (9) can be utilized, insofar as the function f is attempted to be determined.

$$OG(\forall\theta) << \mathrm{MIN}(L_2, L_{21}, L_{22}+L) \tag{8}$$

Where, ∀: universal quantifier.

MIN; minimum value of plural figures given in parenthesis $$Od \approx L \tag{9}$$

Generally, as long as the function f is at least attempted to be determined, even if the points O and G are treated as being the same, the resulted error in the determined function f is adequately small. The reason is that the lengths $L_2$, $L_{21}$, $L_{22}$ are on the order of about 10 cm–about 1 m, while the distance OG is on the order of 1 μm of length.

Consequently, it will be understood from FIG. 2 that the function f can be determined specifically by the use of the following equations (10)–(22), on the premise that the points O and G are treated as identical with each other.

$$L_2^2 = L_{21}^2 + (L_{22}+L)^2 - 2L_{21}(L_{22}+L)\cos\zeta \tag{10}$$

$$u = R\cos\phi \tag{11}$$

$$v = R\sin\phi \tag{12}$$

$$w = x - u \tag{13}$$

$$OP^2 = (H-v)^2 + (w+D)^2 \tag{14}$$

$$\beta_1 = \tan^{-1}\{(H-v)/(w+D)\} \tag{15}$$

$$\beta_2 = \cos^{-1}\{(-L_2^2 + L_1^2 + OP^2)/(2L_1 \cdot OP)\} \tag{16}$$

$$\gamma_1 = \beta_2 - \beta_1 \tag{17}$$

$$\gamma_2 = \gamma_1 + \gamma_3 - \pi/2 \tag{18}$$

$$\gamma_3 = \cos^{-1}\{(-\mathrm{OP}^2 + L_1^2 + L_2^2)/(2L_1 \cdot L_2))\} \tag{19}$$

$$\beta_3 = \beta_4 - \gamma_2 \tag{20}$$

$$\beta_4 = \cos^{-1}[\{-L_{21}^2 + L_2^2 + (L_{22}+L)^2\}/\{2L_2(L_{22}+L)\}] \tag{21}$$

$$\theta = 3\pi/2 - \phi + \beta_3 \tag{22}$$

It will be understood from the above explanation using various equations that the relationship among the angle θ, rotating angle ϕ, and distance "x" can be determined without dependency on a change in the attitude of the sliding means, and therefore, the function f satisfying the equation defined as "θ=f(ϕ,x)." Accordingly, the aforementioned variable-transformation for transforming the function y(ϕ,x) into the function y(θ) can be achieved. In other words, it has been proved that an operation of measuring the measurement variables y, x, ϕ concurrently with one another permits the calculation of the function y(θ) without removal of a workpiece in the form of the crankshaft which is supported by a machine rotatably about the C-axis, out of the machine.

Figure 4:
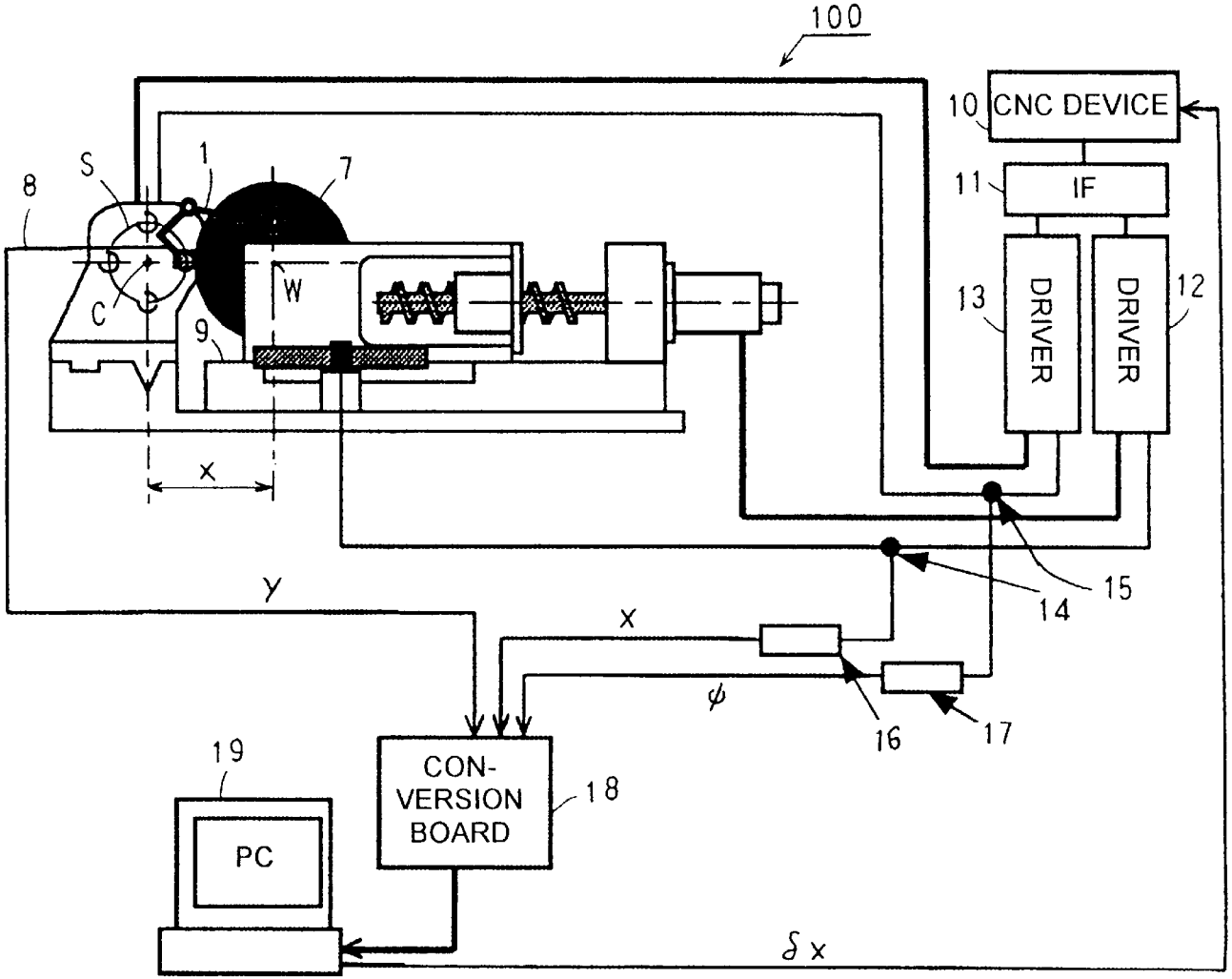
FIG. 4 is a view illustrating a construction of the cylindrical grinding machine 100 of FIG. 1.

Referring next to FIG. 4, there will be described the construction of the cylindrical grinding machine 10. The machine 10 permits the measurement variables y, x, ϕ to be measured concurrently with one another. The distance "x" between the C and W axes is controlled by the servomechanism incorporating a driver 12 and otherwise. The rotating angle ϕ of the crankpin about the C-axis is controlled by the servomechanism incorporating a driver 13 and otherwise. A CNC (Computerized Numerical Control) device 10 controls the drivers 12, 13 connected with the CNC device 10 via an IF (Interface) 11. Reference numerals 14, 15 denote respective directional couplers for sine-wave signals, while 16, 17 denote respective waveform shapers.

In the cylindrical grinding machine 10 constructed as previously described, the measured vales of the measurement variables y, x, ϕ can be concurrently transmitted to a PC (a personal computer) 19 through a conversion board 18 in a real-time manner. Therefore, by employing the relationships between variables as described above, the PC 19 can determine the function y(θ) on the basis of the measurement variables y, x, ϕ.

After the function y(θ) is specified in the manner described above, the use of the above equations (4)–(6) and the harmonic analysis enables the output y(θ) to be expanded in the form of the above equation (3). It is supposed that the opposing angle α of the V-gauge 25 has been selected as a suitable value. In this case, since the expansion coefficients $c_n$ and initial phases $\phi_n$ for all the indexes n indicated above can be determined, the aforementioned radius "r" of the circumference "K" can be obtained in the form of the function r(θ) represented as the above equation (1). In the present embodiment, a portion of the PC 19 assigned to calculate the function r(θ) as the circularity deviation of the circumference "K" constitutes one example of a circularity deviation calculating means.

More specifically, the PC 19, especially a program to be executed by the PC 19 is adapted to sequentially implement step e 10 to receive from the CNC device 10, values of the measuring variables y, x, ϕ, which values have been concurrently measured during rotation of the circumference "K" around the C-axis, step e 20 to identify the function f, step e 30 to transform the function y(ϕ, x) into the function y(θ) by the use of the identified function f, and step e 40 to obtain the function r(θ) according to the above equations (4)–(6) and by the use of the harmonic analysis.

In the presently preferred embodiment, since the PC 19 and the CNC device 10 are interconnected by communication wires in the manner shown in FIG. 4, an amount of correction δx obtained by the circularity deviation calculating means described above and correction calculating means which will be described can be automatically and quickly transmitted to the CNC device 10. The correction calculating means for calculating the amount of the correction δx will be described.

Figure 5A:
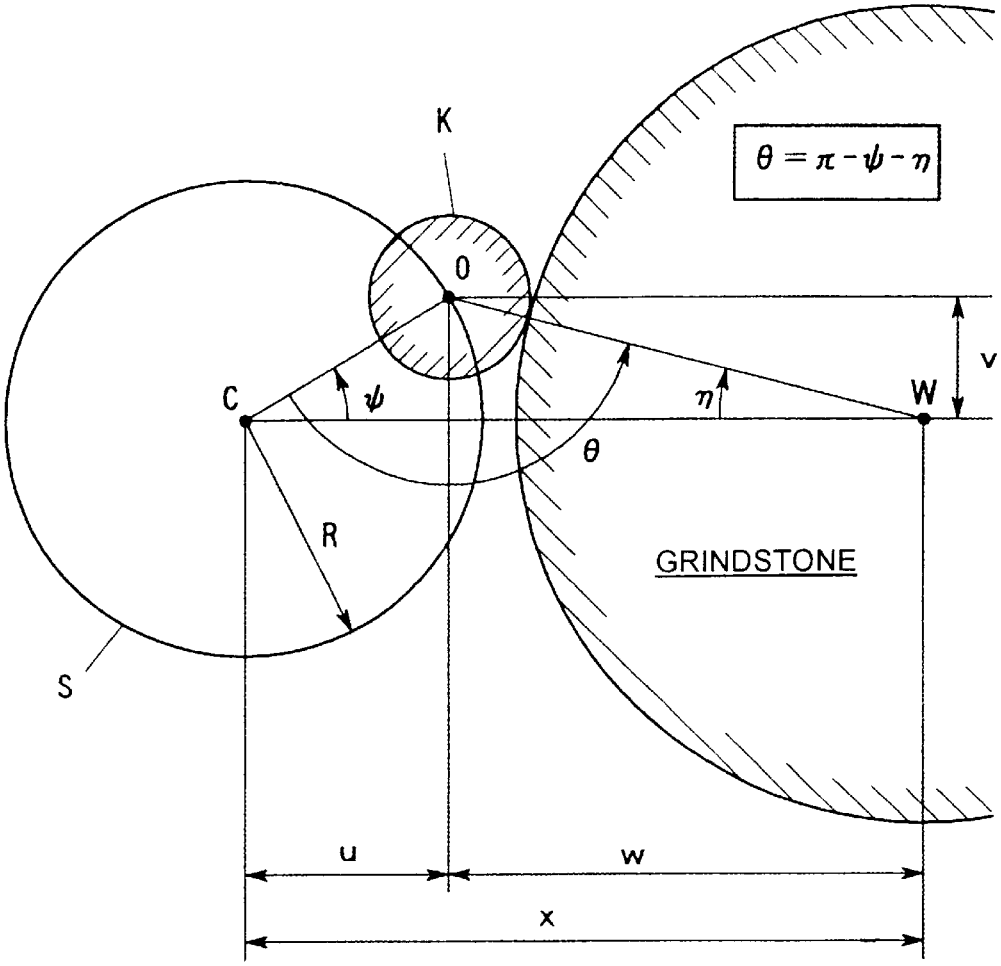
FIGS. 5A and 5B are views for explaining how an amount of correction $\delta x(x, \phi)$ is obtained according to the first embodiment of this invention.
Figure 5B:
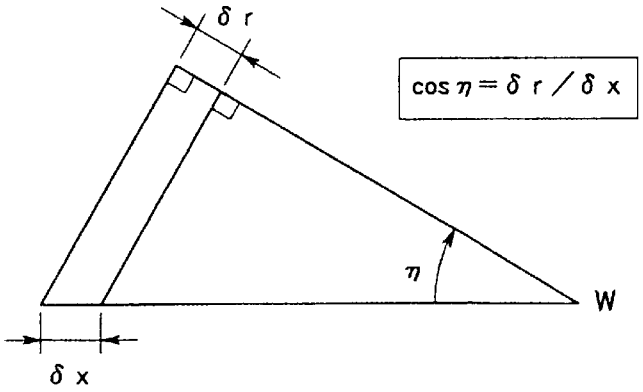

Referring next to FIG. 5, how to calculate the amount of correction δx such that the amount is held constant irrespective of the value of the angle θ will be described. The amount of correction δx is defined as an amount of correcting the distance "x" between the C and W axes for each discrete value of the rotating angle ϕ, that is, an amount of correcting an amount of movement of the grindstone stand 9.

It will be clear from FIG. 5 that the amount. δx can be obtained according to the following equations (23)–(28), for example:

$$\theta=\pi-\phi-\eta(\eta\equiv\angle CWO) \tag{23}$$

$$\delta r(\theta)=r(\theta)-\lambda_I a_m(\lambda_I\geqq 1) \tag{24}$$

$$\delta X=\delta r(\theta)/\cos\eta \tag{25}$$

$$\cos\eta = w/OW = w/(v^2+w^2)^{1/2} \equiv g(x,\phi) = (x-R\cos\phi)/\{(R\sin\phi)^2+(x-R\cos\phi)^2\}^{1/2} \tag{26}$$

$$\eta=\cos^{-1}\{g(x,\phi))\} \tag{27}$$

$$\delta x(x,\phi)=[r(\pi-\phi-\cos^{-1}\{g(x,\phi)\})-\lambda_I a_m]/g(x,\phi) \tag{28}$$

The symbol $\lambda_I$ represents a safety factor preventing the eccentric cylinder from being excessively ground by the machine 10. The safety factor $\lambda_I$ is to be formulated so as to approach "1" as the number of the repeated cycles constructed to sequentially implement grinding, measurement, grinding and measurement for machining the eccentric cylinder in the form of the crankshaft is increased. Therefore, when the final value of the repetition number is small, the value of the safety factor $\lambda_I$ may be fixed as "1" from the beginning of the repeated grinding cycles.

The amount of correction δx can be calculated in the aforementioned manner. Therefore, when the value of the distance "x" of the X-axis corresponding to the previous value of the rotating angle ϕ is used, the next value "x'" of the distance "x" corresponding to the next value of the rotating angle ϕ can be obtained according to the following equation (29).

$$x'(\phi)=X(\phi)-\delta x(\phi) \tag{29}$$

The cylindrical grinding machine 10 constructed in the above manner, permits the eccentric cylinder to be automatically machined so as to approach an ideal one, without removal of the eccentric cylinder supported rotatably by the machine 10 therefrom.

As a result of constructing the cylindrical grinding machine 10 in the above manner, the following results can be provided:

(a) A circularity deviation of an eccentric cylinder can be measured with the eccentric cylinder installed on a machine for machining the eccentric cylinder, resulting in the fact that an error in the phase angle (i.e., angle θ) of the eccentric cylinder between data representing the measured values and data for controlling the machine is eliminated.

(b) A circularity deviation of an eccentric cylinder can be measured without aligning the center of the eccentric cylinder with the rotation center of the measuring device. As a result, when a plurality of workpieces each having different circularities, radii, or phase angles, each one of these workpieces can be measured about their circularities after one chucking operation of each workpiece, irrespective of the number of eccentric cylinders of each workpiece.

(c) Profile data for controlling a position of a grindstone stand of a machine in the X-axis can be automatically corrected.

(d) Since the displacement of the circumference "K" is measured in the V-gauge method, the measurement region of a measuring portion (e.g., the measuring head) is narrowed. As a result, the environment resistance to conditions including temperatures tend to cause a problem when the measuring device is operated with it mounted on the machine is improved.

It is additionally noted that the present invention may be practiced without installation of the PC 19 on the cylindrical grinding machine 100 of FIG. 4. In this case, the machine 100 may be modified such that the output of the conversion board 18 is directly supplied to the CNC device 10, and it functions to provide the circularity deviation calculating means and the correction calculating means mentioned above.

While the sliding means of the cylindrical grinding machine 100 according to the first embodiment of this invention is fixed to the grindstone stand 9, it is unnecessary that the sliding means is coupled with the grindstone stand such that the sliding means is moved with the grindstone stand.

In addition, while the sliding means according to the first embodiment of the invention is constructed using a link mechanism, it is also unnecessary that the sliding means is constructed in that manner.

In those modified arrangements, a variable-transformation means such as the a function f can be formulated using constants including lengths or angles of parts of the sliding means or the machine (i.e., a group of sliding mechanism parameters for each device), as well as in the first embodiment of the invention.

In those modifications, since the function y(θ) can be obtained from various constants representing the structure associated with the attitude of the sliding means, according to the invention, the same function and results as the invention provides can be achieved like in the first embodiment of the invention.

What has been previously described about the first embodiment of the invention is that, by the use of the technology of measuring the measuring variables y, x, ϕ concurrently with one another, the function y(θ) for a workpiece held rotatably about a rotation axis in a machine can be obtained, without removal of the workpiece out of the machine, with the workpiece held in position in the machine. The technology of concurrently measuring the measuring variables y, x, ϕ may be specified in the following manners:

(Manner 1) A manner of measuring at fixed time intervals

According to manner 1, the measurement is effected in response to discrete signals for triggering the respective measurements, which signals are to be generated at fixed intervals. In the manner, when a workpiece (e.g., the crankshaft) is rotated at a constant velocity, for example, the number of the measuring points is determined depending upon a length of a time required for one revolution of the workpiece, which length is obtained from a rotation velocity of the workpiece, and a predetermined time period at which the discrete signals for triggering are generated.

(Manner 2) A manner of measuring at fixed intervals of a rotating angle of a workpiece Each time the rotating angle ϕ about the C-axis is increased by a fixed angle, a synchronization signal is generated to perform the concurrent measurement of the measuring variables y, x.

Alternatively, the rotating angle ϕ can be replaced with the distance "x". More specifically, each time the distance "x" takes one of a predetermined value in the X-axis at one of a predetermined positions for measurement, the synchronization signal is generated to effect the concurrent measurement of the measuring variables ϕ, y.

(Manner 3) A manner of utilizing commanded values for the servo-control for controlling a machine It is possible that the rotating angle $\phi$ and distance "x" are obtained by operation of respective sensors exclusively detecting actual values of the rotating angle $\phi$ and distance "x". These sensors can be constructed as a rotary encoder, a linear encoder, a potentiometer, or otherwise. The sensors are connected with the PC 19 so that it receives from the sensors data indicative of values of the rotating angle $\phi$ and distance "x" measured by the sensors.

It is also possible to employ commanded values which are specified and generated by the operator of the machine 100 and the CNC device 10. The commanded values are provided to be used for a control (i.e., the servo-control) for controlling physical motions such as a rotary motion of a workpiece about the C-axis or a motion of the grindstone stand. In this case, it is required that an amount of delay in a following-up operation in the servo-control is small enough to be able to be ignored to an adequate extent, so that the grindstone stand and the workpiece including the eccentric cylinder are rotated and moved in an adequately quick response to the generated commanded values, leading to an adequately high degree of accuracy in position of the stand and the workpiece.

In this arrangement, a portion of the CNC device 10 which is assigned to obtain the commanded values and send them to the PC 19 cooperates with the aforementioned circularity deviation calculating means to constitute one example of circularity deviation calculating device according to an embodiment of the present invention.

In addition, the invention may be effectively utilized as a circularity deviation measuring apparatus not having grinding means such as a grindstone, as well. The reason is that this apparatus can obtain the radius function $r(\theta)$, as well, and therefore the apparatus can be utilized as a circularity deviation measuring apparatus according to the invention.

(Second Embodiment)

After a motion parameter t related to a mechanical motion of a sliding means such as the sliding means used in the first embodiment of the invention, for example, is detected, if a position (i.e., an amount of eccentricity "R" and/or a rotating angle $\phi$ as shown in FIG. 2) of an axis of an eccentric cylinder subjected to a machining operation (referred to as a "true-circle machining operation") effected such that a profile of an actual cross section of the eccentric cylinder approaches a geometrically true circle (referred to as a "true circle") is accurately obtained on the basis of the previously measured motion parameter $\xi$, the true-circle machining operation will be able to be performed with a further improved degree of machining accuracy.

Figure 6:
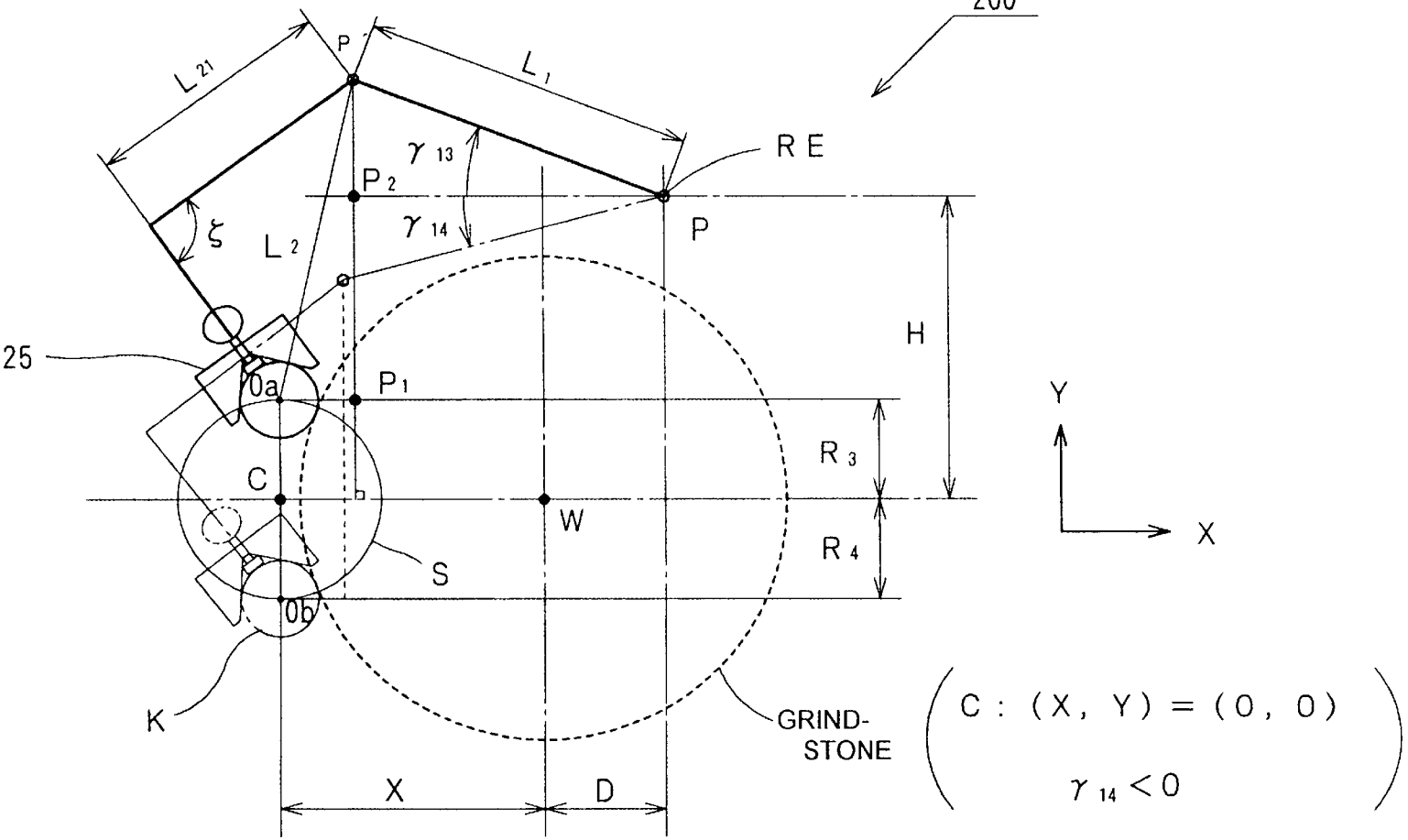
FIG. 6 is a cross section schematically illustrating a cylindrical grinding machine 200 according to a second embodiment of this invention, the machine 200 being equipped with a pivoting angle sensor (in the, form of a rotary encoder RE)

Referring to FIG. 6, there will be described a cylindrical grinding machine 200 according to a second embodiment of the invention, which machine 200 is equipped with a pivoting angle sensor in the form of a rotary encoder RE. The cylindrical grinding machine 200 is constructed by adding the rotary encoder RE (one example of the pivoting angle sensor) to the cylindrical grinding machine 100 (as shown in FIGS. 1 and 2) according to the first embodiment of the invention, at the first pivot P. The rotary encoder RE is designed to detect a pivoting angle $\gamma_1$ of the first arm 1 as an angle about a point P shown in FIG. 6, relative to an original line PP2 located on the horizontal plane on which the point P is located. The detected value of the pivoting angle $\gamma_1$ is positive when the first arm 1 is pivoted clockwise on the plane of FIG. 6.

In the preferred embodiment of the invention, the aforementioned motion parameter t corresponds to the pivoting angle $\gamma_1$ of the first arm 1. In FIG. 6, points P1, P2 are located on the common vertical line extending from the second pivot P'.

As described below in more detail by reference to FIGS. 7–9, an apparatus such as the cylindrical grinding machine 200 would permit the calculation of phase angle errors $\Delta\phi$ associated with the position of the axis of the eccentric cylinder to be subjected to the true-circle machining operation, and the calculation of the amount of the circularity "R" with a higher degree of accuracy, for example.

The calculated phase angle errors $\Delta\phi$ may be used for the correction of the rotating angle $\phi$ about the C-axis during the true-circle machining operation, for example. In addition, if a more accurate amount of the circularity R is obtained, an amount of movement "x" of the grindstone stand 9 in the X direction during the true-circle machining operation can be more accurately determined.

Alternatively, in place of the correction of the rotating angle $\phi$ about the C-axis on the basis of the phase angle errors $\Delta\phi$, a timing for achieving the amount of the movement x may be deviated by a time corresponding to the phase angle errors $\Delta\phi$ with the aid of synchronization controlling means which will be described.

Figure 7:
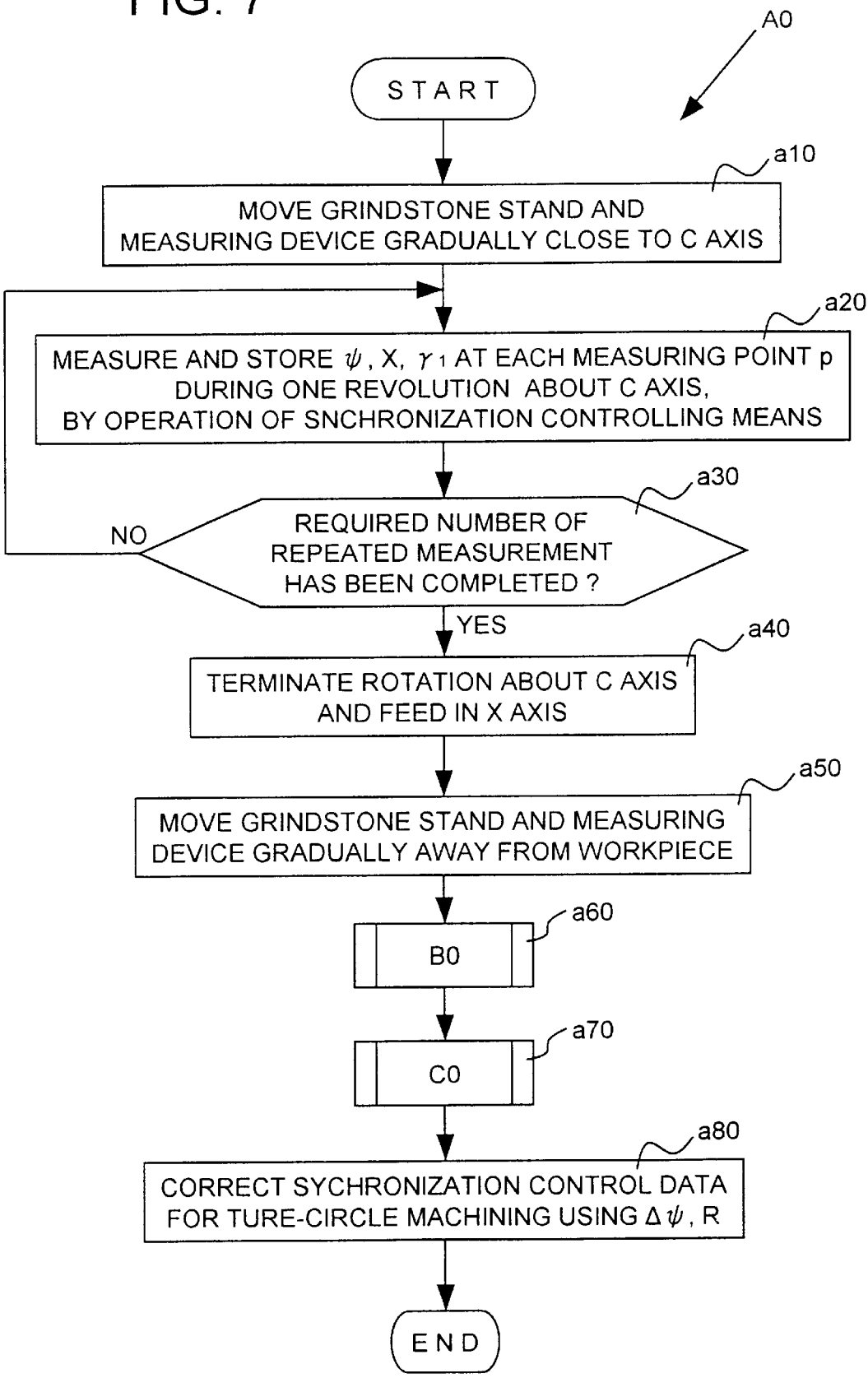
FIG. 7 is a general flow chart illustrating a measurement main-program A0 controlling the cylindrical grinding machine 200 of FIG. 6.

Referring next to FIG. 7, there will be described a measurement main-program A0 implemented by a computer of the cylindrical grinding machine 200 for control thereof. The computer may be constructed as one described in relation to the first embodiment of the invention, namely, the PC 19 or the CNC device 10.

The program A0 is initiated with step a 10 to perform the installation of a measuring device of a three-point contact type. The installation is performed such that the measuring device comes close to the C-axis for permitting the measuring, to be prepared for entry into a workpiece in the form of a crankshaft, for example, held by the machine 200. The installation is further effected such that the measuring device is advanced into the workpiece for contact of a riding gauge (i.e., V-block) incorporated by the measuring device with an eccentric cylinder (e.g., a crankpin) at its outer circumference.

The program A0 proceeds to step a 20 where, by operation of the sliding means, the measuring device (i.e., V-block) is moved along a lateral surface of the eccentric cylinder in contact with the lateral surface In the step, additionally, the workpiece is rotated about the C-axis by one revolution from an arbitrary angular position in a direction (in FIG. 2, corresponding to a counterclockwise direction) permitting the rotating angle Q to be increased, with the circumference "K" (as shown in FIG. 3) being in usual contact with contact surfaces A, B (as shown in FIGS. 3 and 6) of the V-gauge 25 (i.e., a V-block) and the grindstone (as shown in FIG. 6) at three points in total. In the step, furthermore, during the operation of this synchronization control, the rotating angle $\phi$ of the original point O (located at the axis of the eccentric cylinder), a relative position x of the grindstone and the pivoting angle $\gamma_1$ of the first arm 1 are measured. The measured values are stored as data in a memory of the computer of the cylindrical grinding machine 200.

During one cycle of the measuring operation, the original point O is rotated along the circle orbit "S" as shown in FIGS. 1, 2 and 6 by one revolution. In this case, intervals between adjacent two measuring points "p" (namely, density of measuring points "p") may be evenly determined along the entire of circular orbit "S".

In addition, as described below in more detail, if intervals of the measuring points "p" in the proximity of positions permitting the rotating angle $\phi$ to be "−90" and "+90"

degrees are smaller than ones at other positions on the circular orbit "S" located on a X-Y coordinates shown in FIG. 6, it is more efficient in effecting calculations in subroutines B0 and C0 with a high degree of accuracy.

The step a 20 above described is followed by step a 30 where a determination as to whether a required number of the repeated measurements effected in the step a 20 have been completed.

The program A0 proceeds to step a 40 where the rotation of the workpiece about the C-axis and a feeding movement of the workpiece in the direction of the X-axis are terminated.

Next, in step a 50, the measuring device in the form of the measuring instrument of the three-point contact type is lifted and the grindstone stand 9 is moved back. As a result, the measuring device and the grindstone stand 9 are moved away from the workpiece.

Then, in step a 60, a phase angle error calculation sub-routine B0 (shown in FIG. 8) which will be described in detail is called to be implemented to calculate the phase angle errors $\Delta\phi$ of the original point O.

Next, in step a 70, an eccentricity calculation sub-routine C0 (shown in FIG. 9) which will be also described in detail is called to be implemented to calculate the amount of eccentricity "R" of the original point O.

Afterward, in step a 80, data for the synchronization control, namely, profile data as described in relation to the first embodiment of the invention, which data is intended to be used for the true-circle machining operation of the eccentric cylinder, on the basis of the obtained phase angle errors $\Delta\phi$ and amount of eccentricity "R" of the original point O.

The thus obtained phase angle errors $\Delta\phi$ can be used for correction of the rotating angle $\phi$ about the C-axis during the true-circle machining operation effected by the synchronization controlling means mentioned above, for example. Further, the use of a more accurate amount of eccentricity "R" would be able to lead to a more accurate determination of the amount of movement x of the grindstone stand 9 in the X direction during the true-circle machining operation.

Figure 8:
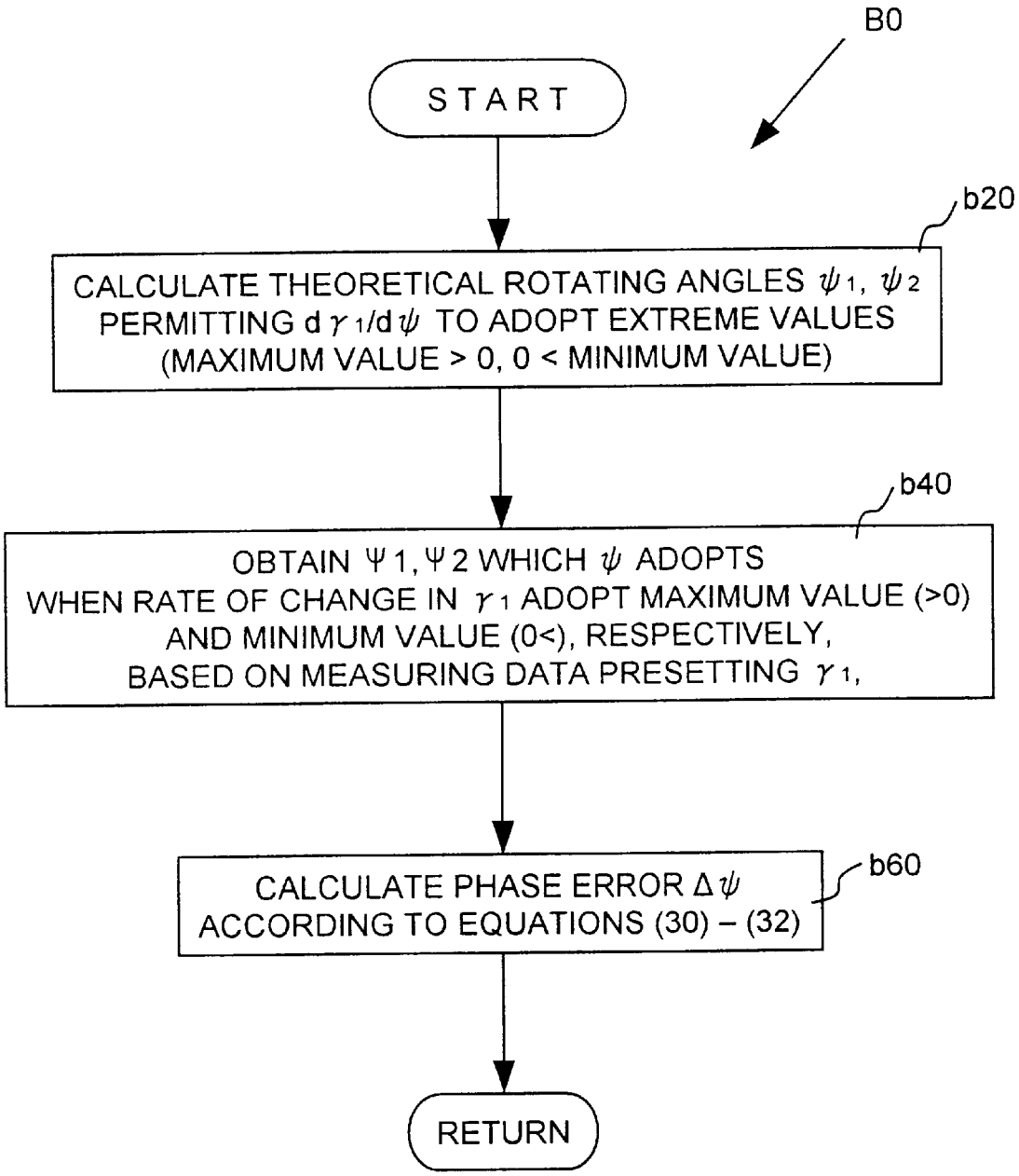
FIG. 8 is a flow chart illustrating a phase-angle-error-calculation sub-routine B0 called by the measurement main-program A0 of FIG. 7.

Referring next to FIG. 8, there will be described the phase angle error calculation sub-routine B0 to be called by the measurement main-program A0.

The sub-routine B0 starts with step b 20 wherein theoretical values $\Psi_1$, $\Psi_2$ of the rotating angle $\phi$ permitting a derived function of first order "$d\gamma_1/d\phi$" to adopt the extreme values (the minimum value <0, the maximum value >0), according to the above equations (10)–(17). The derived function is obtained by differentiating the pivoting angle $\gamma_1$ of the first arm 1, with respect to the rotating angle $\phi$. In light of the fact that the calculation is a theoretical one, independent of the measurement to be effected by the main-program A0, the calculation may be performed prior to the execution of the main-program A0.

The sub-routine proceeds to step b 40 where actual values $\Psi_1$, $\Psi_2$ which the rotating angle $\phi$ adopts when rates of change in the pivoting angle $\gamma_1$ with relation to the rotating angle $\phi$ adopt the maximum value (>0) and minimum value (<0), respectively, by analyzing data representing the measured values of the pivoting angle $\gamma_1$ and rotating angle $\phi$. When intervals between adjacent two measuring points p are predetermined to be evenly distributed around the circle orbit S, values of the rotating angle $\phi$ obtained when the rate of change in the pivoting angle $\gamma_1$ is the maximum value (>0) and the minimum value (<0), respectively, may be used as the actual values $\Psi_1$, $\Psi_2$ mentioned above. In addition, when the intervals are relatively large, the actual values $\Psi_1$, $\Psi_2$ may be obtained by the use of various interpolations such as an appropriate expression based on an equation of parabola, for example.

The sub-routine B0 then proceeds to step b 60 where the phase angle errors $\Delta\phi$ of the original point O are calculated according to the following equations:

$$\Delta\phi_1=\Psi_1-\phi_1 \tag{30}$$

$$\Delta\phi_2=\Psi_2-\Psi_2 \tag{31}$$

$$\Delta\phi=(\Delta\phi_1+\Delta\phi_2)/2 \tag{32}$$

In the present embodiment of the invention, because of the use of the measured values which the rotating angle $\phi$ adopts when rates of change in the pivoting angle $\gamma_1$ with relation to the rotating angle $\phi$ adopt the maximum value (>0) and minimum value (<0), respectively, the phase angle errors $\Delta\phi$ can be obtained with the highest degree of accuracy, while the rotary encoder RE is designed to measure the pivoting angles $\gamma_1$ with the even degree of accuracy within the measuring region, irrespective of the actual value of the pivoting angle $\gamma_1$ to be measured.

Alternatively, one of the phase angle errors $\Delta\phi$, namely, $\Delta\phi_1$ may be obtained according to the following equation (33):

$$\Delta\phi_1=(\gamma_+-\Gamma_+)/(d\gamma_1/d\phi)_+ \tag{33}$$

Where, the symbol "$\Gamma_+$" represents a theoretical value of the pivoting angle $\gamma_1$ at $\phi=0$, which theoretical value is theoretically obtained according to the above equations (10)–(17). The symbol "$\gamma_+$" represents an actual value of the pivoting angle $\gamma_1$ at $\phi=0$, which actual value is actually measured by the execution of the main-program A0. The symbol "$(d\gamma_1/d\phi)_+$" represents a theoretical value of the derived function of first order as described above, at $\phi=0$, which theoretical value is theoretically obtained according to the above equations (10)–(17).

It is to be added that, since the above equation (33) is formulated by the approximation of first order, the equation is valid when the phase angle error $\Delta\phi_1$ is small enough to be able to adequately ignore an amount of change in the rotating angle $\phi$ vis-à-vis an amount of change in "$d\gamma_1/d\phi)_+$."

On the other hand, the other phase angle error $\Delta\phi_2$ may be obtained according to the following equation (34):

$$\Delta\phi_2=(\gamma_--\Gamma_-)/(d\gamma_1/d\phi)_- \tag{34}$$

Where, the symbol "$\Gamma_-$" represents a theoretical value of the pivoting angle $\gamma_1$ at $\phi=\pi$, which theoretical value is theoretically obtained according to the above equations (10)–(17). The symbol "$\gamma_-$" represents an actual value of the pivoting angle $\gamma_1$ at $\phi=\pi$, which actual value is actually measured by the execution of the main-program A0. The symbol "$(d\gamma_1/d\phi)_-$" represents a theoretical value of the derived function of first order as described above, at $\phi=\pi$, which theoretical value is theoretically obtained according to the above equations (10)–(17).

It will be understood from the arrangement shown in FIG. 6 that the sensitivity of the rotary encoder RE with relation to a minute change in the rotating angle $\phi$ is thought to be the highest or adequately high in the vicinity of positions where the rotating angles $\phi$ are 0 and $\pi$, respectively. Accordingly, it is not necessary to use only the measured value of the pivoting angle $\gamma_1$ obtained when the sensitivity of the rotary encoder RE is the maximum value, resulting in that the measured pivoting angles $\gamma_1$ at $\phi=0$ and $\phi=\pi$, respectively, as described above, may be also utilized.

The latter manner for obtaining the phase angle errors $\Delta\phi$ is more preferable for the following reason. The pivoting angle $\gamma_1$ is a function of the rotating angle $\phi$, which function is a periodic one (differentiable more than twice) with a relatively good quality with relation to the rotating angle $\phi$. The derived function of second order of the pivoting angle $\gamma_1$ satisfies "$d^2\gamma_1/d\phi^2 \approx 0$", and accordingly, the above equation (33) is established with an adequate degree of accuracy, although variable ranges of the phase angle errors $\Delta\phi$ are so slightly large as to be in the neighborhood of "1" degree. Such a situation under which the equation (33) is utilized is also applicable when the above equation (34) is utilized.

Figure 9:
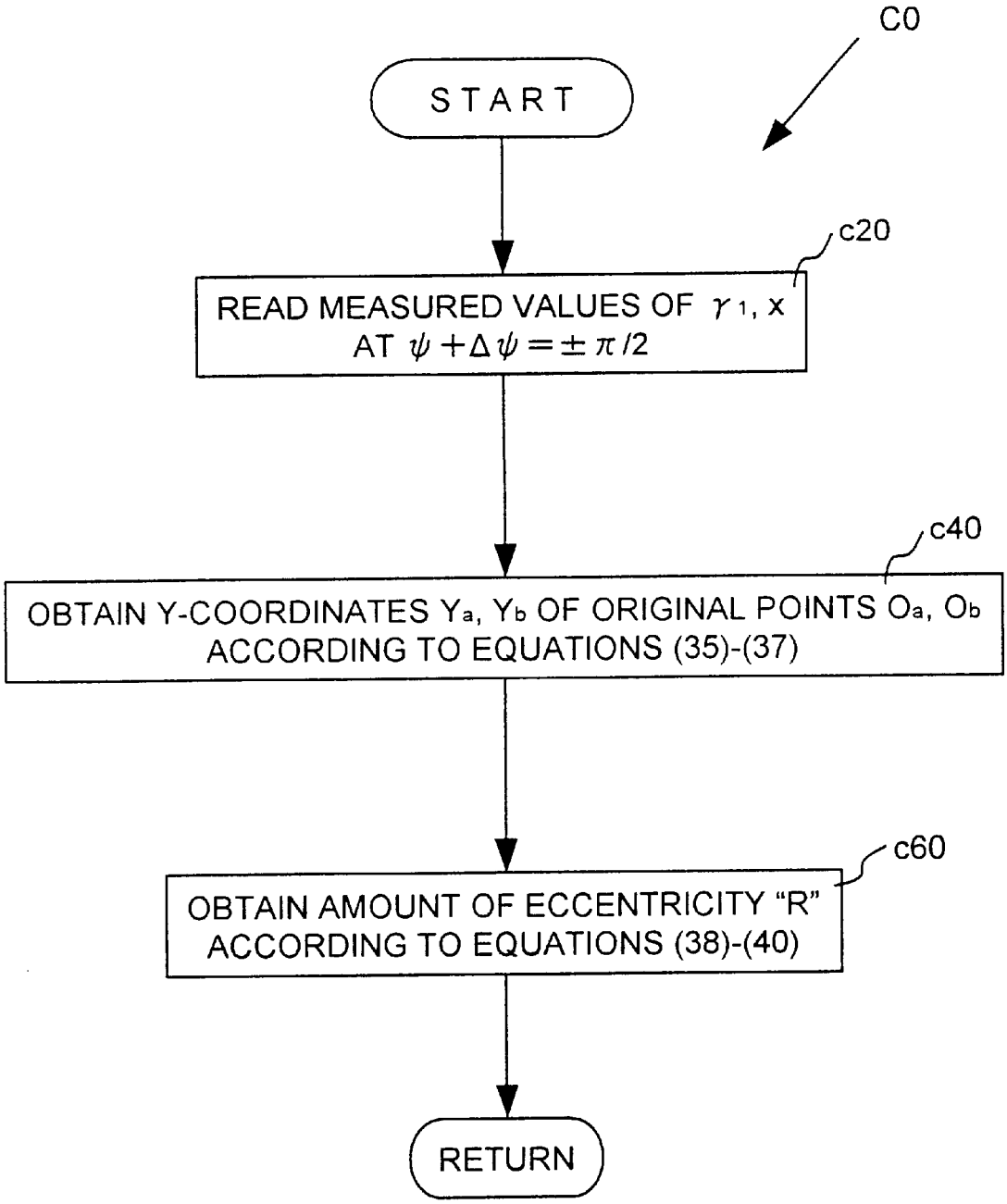
FIG. 9 is a flow chart illustrating an amount-of-eccentricity calculation sub-routine C0 called by the measurement main-program A0.

Referring next to FIG. 9, there will be described the eccentricity calculation sub-routine C0 to be called by the measurement main-program A0.

The sub-routine C0 begins with step c 20 to read data which has been obtained by the execution of the main-program A0 and which has been stored in a memory of the computer mentioned above. More specifically, in the step c 20, data representing a measured value of the pivoting angle $\gamma_1$ of the first arm 1 and a measured value of the relative position x (i.e., the distance between the C- and W-axis in FIG. 1). The measured values of the pivoting angle $\gamma_1$ and relative position x are obtained when the position of the axis (i.e., the original point O) of the eccentric cylinder is located at positions (i.e., the original points $O_a$, $O_b$ in FIG. 6) permitting corrected values of the rotating angles $\phi$ to adopt $+\pi/2$ and $-\pi/2$, respectively. Each of the corrected value is obtained by correcting a corresponding one of the measured values of the rotating angles $\phi$ such that a selected one of the obtained phase angle errors $\Delta\phi$ is added to the measured value, according to the actual angular position of the eccentric cylinder. In addition, when intervals between adjacent two measuring points "p" are relatively large, the actual values of pivoting angles $\gamma_1$ at relevant points (i.e., the original points $O_a$, $O_b$ in FIG. 6) may be obtained by the use of various interpolations such as an appropriate expression based on an equation of parabola, which interpolations are known in the field of a numerical analysis, for example. In this case, the actual values of relative positions "x" at relevant points (i.e., the original points $O_a$, $O_b$ in FIG. 6) may be obtained by the use of a predetermined interpolation, like in the case of the pivoting angles $\gamma_1$ mentioned above.

The sub-routine C0 then proceeds to step c 40 where Y-coordinates $Y_a$, $Y_b$ at the original points $O_a$, $O_b$ are calculated according to the following equations (35), (36) and (37):

$$Y = Y1 - Y2 \tag{35}$$

$$Y1 = H + L_1 \sin \gamma_1 \tag{36}$$

$$Y2 = \{L_2^2 - (x + D - L_1 \cos \gamma_1)^2\}^{1/2} \tag{37}$$

Where, the symbol "Y1" represents the Y-coordinate of the second pivot P' shown in FIG. 6. Further, the symbol "Y2" represents a length (a height) obtained by projecting on a line in parallel to the Y-axis, a segment OP' connecting the original point O (selected one of the two points $O_a$, $O_b$) and the second pivot P'. In other words, the length Y2 is represented as "$L_2\cos\gamma_2$ (See FIGS. 2 and 6)." Therefore, when the axis of the eccentric cylinder coincides with the point $O_a$, the length Y2 is equal to a length of a segment P'P1 in FIG. 6.

More specifically, in order to obtain the Y-coordinate $Y_a$ of the original point $O_a$, for example, each of the pivoting angles $\gamma_1$ in the above equations (36) and (37) is substituted with the measured value (i.e., $\gamma_{13}$ in FIG. 6) of the pivoting angle $\gamma_1$ obtained when the corrected rotating angle $\phi$ (i.e., an original value $\phi$ of the rotating angle $\phi$ plus the phase angle error $\Delta\phi$) is equal to $+\pi/2$. Additionally, the relative position "x" in the above equation (37) is substituted with the measured value of the relative position x obtained at the same time. Finally, the Y-coordinate Y is calculated according to the above equation (35).

Similarly, the Y-coordinate $Y_b$ of the original point $O_b$ is obtained, more specifically, by a procedure including an operation of substituting each of the pivoting angles $\gamma_1$ in the above equations (36) and (37) with the measured value of the pivoting angle $\gamma_{14}$ obtained at the same time as one for obtaining the Y-coordinate $Y_a$.

The sub-routine C0 then proceeds to step c 60 where the amount of eccentricity "R" of the eccentric cylinder is calculated according to the following equations (38), (39) and (49):

$$R_3 = Y_a \tag{38}$$

$$R_4 = -Y_b \tag{39}$$

$$R = (R_3 + R_4)/2 \tag{40}$$

The thus constructed cylindrical grinding machine 200 adapted to be controlled in the above manner permits the true-circle machining operation of an eccentric cylinder such as a crankpin, to be performed automatically with an improved machining accuracy, without removal of a workpiece as a crankshaft, incorporating the eccentric cylinder from a machine holding the workpiece rotatably for machining the workpiece.

The following results are provided by configuring and controlling the cylindrical grinding machine 200 in the manner as described above:

(a) An circularity deviation of an eccentric cylinder of a workpiece held by a machine can be measured without removal of the workpiece from the machine, resulting in that there is reduced or zeroed a difference in an error of a phase angle of the eccentric cylinder about a rotation axis of the workpiece, between data indicative of measurements and one indicative of the machining condition, and consequently, contributing to an improved accuracy of measuring the circularity deviation.

For example, when an eccentric cylinder in the form of each of a plurality of crankpins of a crankshaft intended for an engine having a plurality of cylinders is required to be machined in the true-circle machining manner, each crankpin can be machined so as to have its accurate angle relative to a crank journal of the crankshaft. As a result, an ignition timing for each cylinder of the engine can be assured extremely accurately, leading to an improved power output of the engine and a remarkable reduction in vibration, noise and fuel consumption of the engine.

(b) A circularity deviation of an eccentric cylinder can be measured without aligning the center of the eccentric cylinder with a rotation center of a measuring device. As a result, when a plurality of workpieces each having different circularities, radii, or phase angles, each one of these workpieces can be accurately measured about their circularities after one chucking operation of each workpiece, irrespective of the number of eccentric cylinders of each workpiece.

For example, when an eccentric cylinder in the form of each of a plurality of crankpins of a crankshaft intended for an engine having a plurality of cylinders is required to be machined in the true-circle machining manner, each crankpin can be machined with a desirably accurate amount of eccentricity with relation to a crank journal of the crankshaft. As a result, a length of a stroke (represented by the double of the actual eccentricity) of each piston slidably received in each cylinder of the engine can be extremely accurate, with the result that an actual compression ratio of a gas to be ignited in each cylinder of the engine is extremely accurate. For the reason, there is eliminated or zeroed an amount of unevenness in a compression ratio among the plurality of cylinders in the engine, facilitating to achieve a desired balance in a power output among the plurality of cylinders, leading to a significant amount of reduction in vibration, noise, and fuel consumption of the engine;

(MEANS FOR AUTOMATICALLY CORRECTING SLIDING MEANS-RELATED PARAMETERS)

There are cases where correction of at least one of values of parameters related to the attitude of the sliding means (i.e., means for sliding the V-block), such as parameters (i.e., the deviation "D", height "H", radius "R", length "$L_1$", length "$L_{21}$", length "$L_{22}$", angle $\zeta$ described above) constituting the group $\Lambda$ indicated above is required for replacement, repair or adjustment of the measuring device of the three-point contact type or the V-block.

In one of these cases, the current V-block is replaced with a new one due to wear or damage of the current V-block, or for changing the opposing angle $\alpha$ of the V-block for the next use.

For example, in the case of the cylindrical grinding machine 200 shown in FIG. 6 according to the second embodiment of the invention, which machine has the pivoting angle sensor in the form of the rotary encoder RE, if the current V-block has been replaced with a new one for changing the opposing angle $\alpha$ of the V-block for the next use, values of the length "$L_{22}$" and distance "L" shown in FIG. 2 will be changed. In the present embodiment, by the use of the pivoting sensor in the form of the rotary encoder RE, new values the length "$L_{22}$" and distance "L" which have become unidentified as a result of the replacement of the V-block are automatically determined according to the following procedure:

(1) There is first prepared a gauge cylinder whose radius is exactly equal to a predetermined radius $a_m$ and which are not eccentric with the C-axis. The gauge cylinder may be provided as a part of a machine machining for the eccentric cylinder, which part is already prepared in the machine. Alternatively, the gauge cylinder may be provided as a cylindrical workpiece located coaxial with the C-axis, which workpiece has been subjected to the predetermined true-circle machining operation, with the result that the radius of the cylindrical workpiece can be identified.

(2) Data representing the opposing angle $\alpha$ and the radius $a_m$ of the gauge cylinder is entered into or designated in the computer of the cylindrical grinding machine 200.

(3) The values of the length "$L_{22}$" and distance "L" are automatically determined by the cylindrical grinding machine 200 according to the following manner:

(a) The value of the distance "L" is determined according to the following equation:

$$L=a_m/\sin(\alpha/2) \tag{41}$$

(b) The V-block (i.e., the riding gauge) is brought into contact with a cylindrical surface of the gauge cylinder at two positions of the cylindrical surface, and additionally, the measuring head of the measuring device is also brought into contact at an end face of the measuring head with the cylindrical surface of the gauge cylinder.

(c) While the V-block and measuring head are held in contact with the cylindrical surface of the measuring device, a value of a for-measuring parameter "s" permitting the actual output of the measuring device when the measuring head is exactly located at the reference point "d" (i.e., the reference point "d" of the V gauge 25) of the measuring device of the three-point contact type, to be equal to a zero point thereof, is substituted with a value "$L-a_m$" meaning the current position of the end face of the measuring head, for thereby achieving a zero adjustment for the reference point "d".

Where, the for-measuring parameter "s" is positive when the measuring head has been moved from a position at which the measuring head contacts the gauge cylinder in the direction of movements of the measuring, toward the axis of the gauge cylinder.

This manner permits a value of the for-measuring parameter s when the measuring head is located at the reference point "d" to be zeroed.

(d) There is detected the output $\gamma_1$ of the rotary encoder RE.

(e) The value of the length "$L_{22}$" is obtained according to the above equations (10)–(17) and by the substitution of variables of an equation which has already been solved with relation to the length "$L_{22}$", with a known variable which is one of the parameters for the sliding means, more specifically, the detected output $\gamma_1$ as previously mentioned. In the present embodiment, the gauge cylinder is positioned not eccentric with the C-axis, and therefore, the amount of eccentricity "R" of the gauge cylinder is a zero, and the value of the rotating angle $\phi$ is an arbitrary one.

The above procedure permits the automatic correction or adjustment of a part of parameters belonging to the group $\Lambda$, namely, the length "$L_{22}$" and the distance "L", on the basis of the measured value of the motion parameter $\lambda$ (i.e., the pivoting angle $\gamma_1$), resulting in a significantly improved efficiency of required operations for replacement, repair or adjustment of the measuring device of the three-point contact type or the V-block.

(GRADUALLY SEQUENTIAL TRUE-CIRCLE MACHINING OPERATION)

In the present embodiment of the invention; a cycle of the true-circle machining operation consisting of steps is repeated, with a gradually increasing accuracy of the machined eccentric cylinder as the true-circle machining operation is advanced in steps.

The constituent steps of the cycle include: the measurement of the phase angle errors $\Delta\phi$ of the axis of the eccentric cylinder, the measurement of the amount of eccentricity "R" of the axis of the eccentric cylinder; the correction of the position of the axis of the eccentric cylinder; the calculation of the circularity deviation of the eccentric cylinder; and the grinding operation of the eccentric cylinder.

More specifically, the measurement of the phase angle errors $\Delta\phi$ is performed by the execution of the main-program A0, in particular, the sub-routine B0. The measurement of the amount of eccentricity "R" is performed by the execution of the sub-routine C0. The correction of the position of the axis of the eccentric cylinder is performed with relation to the rotating angle $\phi$ and the amount of eccentricity "R". The calculation of the circularity deviation of the eccentric cylinder is performed on the basis of the corrected values of the rotating angle $\phi$ and amount of eccentricity "R". The grinding operation of the eccentric cylinder is performed on the basis of the data used for the synchronization control, which data is previously corrected depending upon the calculated circularity deviation.

In the present embodiment, the true-circle machining operation is sequentially performed with the gradually improved dimensional: accuracy of the eccentric cylinder.

When the true-circle machining operation is sequentially performed with the gradually improved dimensional accuracy of the eccentric cylinder, like in the present embodiment of the invention, it is more desirable to obtain the phase angle errors $\Delta\phi$ according to the above equations (32)–(34). This desirable manner facilitates to assure a necessary and sufficient degree of the dimensional accuracy, and to reduce a time required for programming and calculation, by virtue of the simplified calculation, leading to an improved utility of the true-circle machining operation.

(SKIP OF MEASURING STEP (OMISSION OF STEP))

In the present embodiment of the invention, during one cycle of the true-circle machining operation of the eccentric cylinder, the measurement of the position of the axis of the eccentric cylinder is repeated only a required number of times, in light of a required degree of machining accuracy.

More specifically, as described above, in the present embodiment, one cycle of the true-circle machining operation consists of a plurality of steps: the measurement of the phase angle errors $\Delta\phi$ of the axis of the eccentric cylinder by the execution of the main-program A0, in particular, the sub-routine B0; the measurement of the amount of eccentricity "R" of the axis of the eccentric cylinder by the execution of the sub-routine C0; the correction of the position of the axis of the eccentric cylinder; the calculation of the circularity deviation of the eccentric cylinder; and the grinding operation of the eccentric cylinder.

In a conceptual case where one cycle of the true-circle machining operation is repeated many times such that the true-circle machining operation is advanced in steps, namely, gradually, the measurement of the phase angle errors $\Delta\phi$ of the axis of the eccentric cylinder can be omitted after the cycle of the true-circle machining operation has been repeated not less than a predetermined number "m" (a natural number not smaller than 2)of times, for example.

For the above reason, at least one of the measurements to be effected in one cycle of the true-circle machining operation may be omitted, under a condition where at least one of the phase angle $\phi$ and amount of eccentricity "R" of the eccentric cylinder is determined to be almost brought into convergence, provided that there has been effected a determination as to whether a predetermined condition of convergence is met.

In light of the above finding, after the number of the repeated cycles of the true-circle machining operation has reached the predetermined number "m", namely, after the predetermined condition of convergence has been met, the cycle of the true-circle machining operation may be modified to consist of the measurement of the phase angle errors $\Delta\phi$ of the axis of the eccentric cylinder by the execution of the main-program A0, in particular, the sub-routine B0; the correction of the position of the axis of the eccentric cylinder; the calculation of the circularity deviation of the eccentric cylinder; and the grinding operation of the eccentric cylinder, or otherwise, to consist of the calculation of the circularity deviation of the eccentric cylinder; and the grinding operation of the eccentric cylinder, for example. This idea permits a further improvement in efficiency in cycles of the true-circle machining operation after the predetermined condition of convergence has been met.

The predetermined number "m" may be a constant whose value is determined initially, or a variable whose value is dynamically determined according to a determination such as one as to whether a predetermined condition of convergence has been satisfied.

(Third Embodiment)

Figures 10A, 10B:
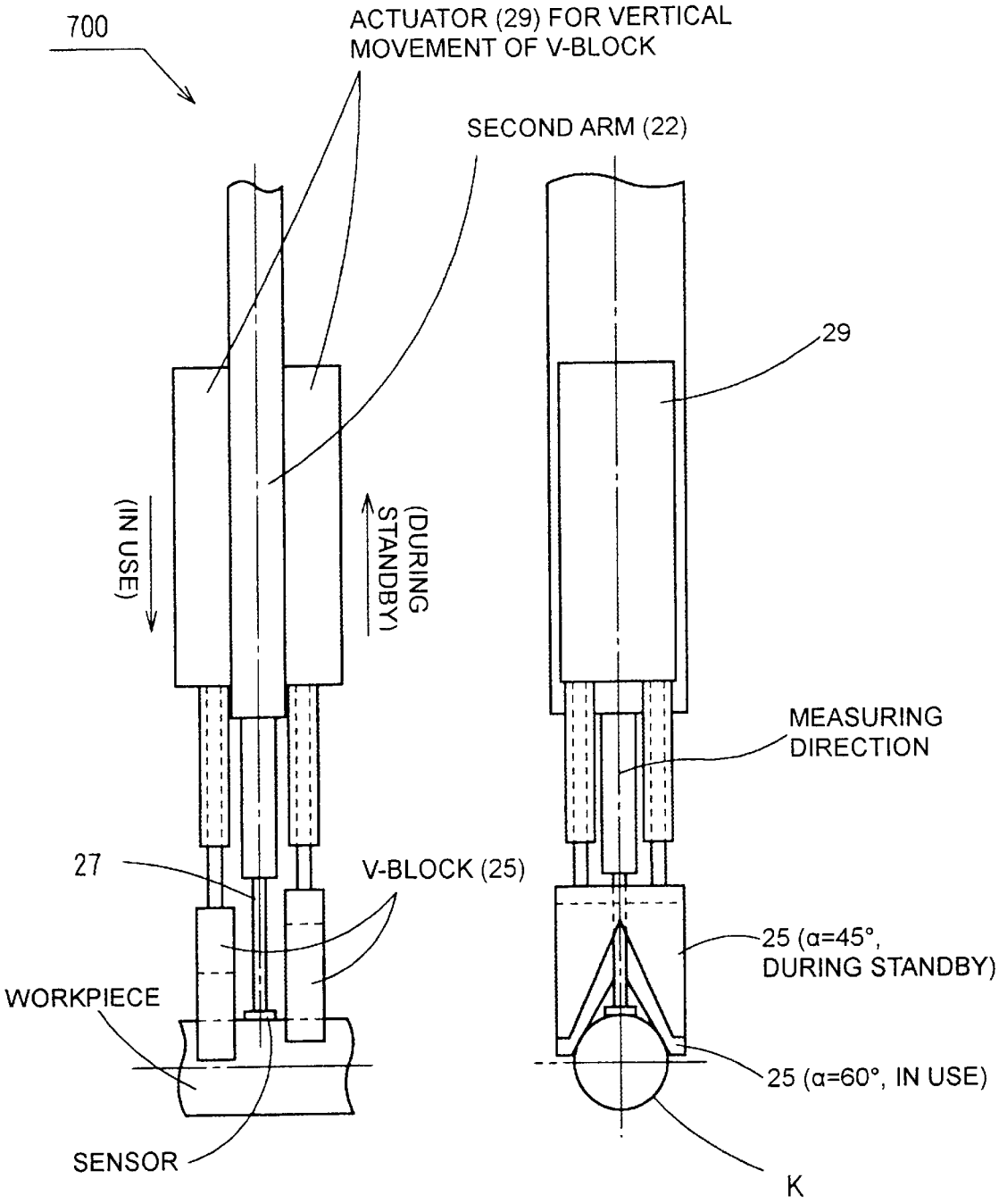
FIGS. 10A and 10B are a side and a front elevation view schematically illustrating a measuring device 700 of a three-point contact type associated with a third embodiment of this invention.

Referring next to FIG. 10, there will be described a measuring device 300 of the three-point contact type according to a third embodiment of the invention. The measuring device 700 is obtained by partially modifying the measuring device of the cylindrical grinding machine 100, which device is constructed by elements indicated at 8, 22, 25, and 27 in FIG. 1. The measuring device 700 is characterized to be equipped with two V-blocks different from each other in the opposing angle $\alpha$ described above.

In the present embodiment, the measuring device 700 is provided with actuators 29 for vertical movements of the respective V-blocks. The actuators 29 are selectively operated such that one of the two kinds of V-blocks is alternately selected to be in use for calculation of the circularity deviation of the eccentric cylinder, each time the angle $\theta$ shown in the above equation (22) or (23) and FIG. 2 or 5 is changed by an amount corresponding to a predetermined number "m" ($m \geqq 1$) of revolutions of the eccentric cylinder about its axis.

The table of FIG. 11 illustrates the magnifications for components of spectrum respective degrees extracted from a dimensional error of an actual circle from a true one, which error is obtained by the measuring device 700 of the three-point contact type. Numerals found in a row for the case where the opposing angle $\alpha$ is "60" degrees in FIG. 11 are the same as one found in a column for the case where the opposing angle $\alpha$ is "60" degrees in FIG. 16.

A combination of two kinds of opposing angles $\alpha$, namely, 45 degrees and 60 degrees, permits each one of absolute values of magnifications for spectrum components of respective degrees extracted from the dimensional error to be a suitable one not less than "1.00", within a region of the degrees up to its maximum one "n" (about "10"$\leqq$n$\leqq$about "50"), which maximum is practically necessary or sufficient. Therefore, the use of the measuring device 700 of the three-point contact type permits the circularity deviation to be measured with an adequately high degree of accuracy, without replacement of V-blocks by manipulation of an operator of the measuring device 700.

In addition, a selection of one opposing angle $\alpha$ as "80" degrees ($\approx$1.40 [rad]) permits each one of an absolute value of each magnifications for spectrum components of respective degrees to be a suitable one not less than a predetermined lower limit (>0) which can barely meet the practical need, within a region of the degrees which are required to be practically considered or which are practically adequate. Consequently, depending upon a required degree of measuring accuracy of the circularity deviation, a selection of one suitable opposing angle $\alpha$ can substitute an indispensable use of two different kinds of V-blocks.

(Fourth Embodiment)

Figure 12A:
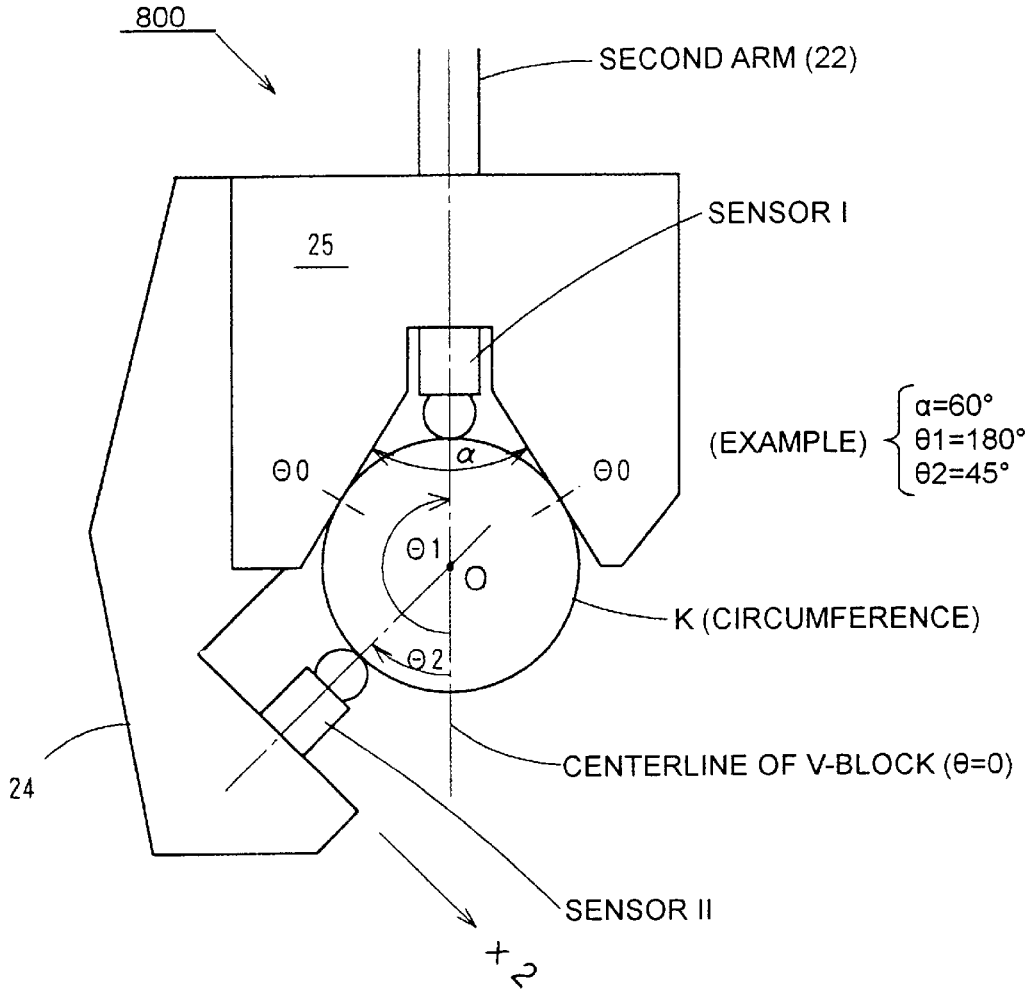
FIG. 12A is a front elevation view schematically illustrating a measuring device 800 of a three-point contact type associated with a fourth embodiment of this invention.

Referring next to FIG. 12A, there will be explained a measuring device 800 of the three-point contact type according to a fourth embodiment of the invention. The measuring device 800 is obtained by partially modifying the measuring device of the cylindrical grinding machine 100, which device is constructed by elements indicated at 8, 22, 25, and 27 in FIG. 1. The measuring device 800 is characterized to be equipped with two sensors I, II for sensing an outer cylindrical surface of an eccentric cylinder of a workpiece, such that the two sensors I, II are arranged at different positions around a centerline of a V-block of the measuring device 800. The centerline is located on a plane for bisecting an opposing angle $\alpha$ of the measuring device 800. There is defined an angle $\Theta$ relative to the centerline represented by "$\Theta=0$", which angle means a phase associated with the aforementioned original point O. The two sensors I, II are located at positions represented by "$\Theta=\Theta_1$" and "$\Theta=\Theta_2$", respectively.

The sensor II, which is located within a region represented by $0 \leqq \Theta_2 < \Theta_0$ as shown in FIG. 12A, can be used as one used in a measuring method of the V-block type described in the aforementioned technical paper titled "METHOD FOR MEASURING CIRCULARITY DEVIATION OF CYLINDRICAL WORKPIECE" (Japan Mechanical Engineering Association, Vol. 53, No. 376, May 1950). On the other hand, the sensor I, which is located within a region represented by $\Theta_0 < \Theta_1 < \Theta_0'$ as shown in FIG. 12A, can be used as one used in a measuring method of the riding gauge type also described in the same technical paper. In FIG. 12A, the angular three positions represented by $\Theta=0$, $\Theta_0$ and $\Theta_0'$, respectively, are evenly distributed around the original point O.

In the present embodiment, the measuring device 800 of the three-point contact type is designed to have an opening at an angular region represented by $0 \leqq \Theta < \Theta_2$ or $\Theta_0' \leqq \Theta < 2\pi$, for assuring a space through which the eccentric cylinder to be measured can be inserted into the measuring device 800.

The measuring device 800 is equipped with a parallel-translation-type adjusting mechanism permitting the sensor II to be moved in a direction of an x2-axis shown in FIG. 12A for positional adjustment of the sensor II, with the angle $\Theta_2$ held in constant during the movement. In addition, the measuring device 800 incorporates a measuring tool in the body of a seating 24 of the measuring device 800. The measuring tool detects and re-determines an amount of parallel translation of the sensor II in the direction of the ×2-axis where appropriate. The parallel-translation-type adjusting mechanism facilitates to increase in degree of freedom in a radius of an object in the form of an eccentric cylinder which can be measured.

The sensors I, II may be provided with a parallel-translation-type adjusting mechanism permitting the sensors I, II to be moved-in respective measuring directions, for positional adjustments of the sensors I, II. In this arrangement, even when a range within which each sensor I, II can detects an object with a required degree of accuracy is relatively small, the parallel-translation-type adjusting mechanism facilitates to increase in degree of freedom in a radius of an object in the form of an eccentric cylinder which can be measured.

Prior to the positional adjustment of the sensor II, the average radius $a_0$ of an eccentric cylinder can be obtained by the use of the sensor I according to the above equations (5) and (6) in the manner described with relation to the first embodiment of the invention. In this arrangement, the thus obtained average radius $a_0$ permits the automatized re-determination (i.e., optimization) of:a desired position (i.e., a desired amount of parallel translation) of the sensor II in the direction of the ×2-axis, responsive to a change in the average radius $a_0$ of the eccentric cylinder.

Prior to the measurement of the circularity deviation of an eccentric cylinder, when its average radius $a_0$ is identified and when the position of the sensor II in the direction of the ×2-axis is fixedly determined (i.e., optimized), a cooperative use of the sensors I, II permits the measurement of the circularity deviation. Therefore, in this arrangement, a time required for measuring the circularity deviation can be reduced into about a half of a time which the measuring device 700 of the three-point type according to the third embodiment of the invention would be required to spend for the same purpose.

The table of FIG. 13 illustrates the magnifications for spectrum components of respective degrees extracted from a dimensional error of an actual circle from a true one, which error is obtained by the measuring device 800 of the three-point contact type. The magnifications for the sensor I ($\Theta$=180 degrees) have been obtained according to the theory of the measuring method of the riding type, while the magnifications for the sensor II ($\Theta$=45 degrees) have been obtained according to the theory of the measuring method of the V-block type.

The above arrangement permits an absolute value of each magnifications for degrees required for measuring the circularity deviation to be not less than "1.00", and at the same time, permits the measuring device 800 to have an opening letting the eccentric cylinder therein over the entire angular region represented by "$0 \leqq \Theta < 45$ degrees or $\Theta_0 < \Theta < 360$ degrees."

The thus constructed measuring device of the three-point contact type enables to measure a circularity deviation with a high accuracy, and at the same time, facilitates an automatization of a mechanical operation of the measuring device, such as a movement for installation on an object to be measured, or one for removal of the object from the measuring device.

Because of the above functions provided by the present embodiment of the invention, the measuring device 800 of the three-point contact type contributes to the true-circle machining operation performed with a high degree of machining efficiency and accuracy.

Referring next to FIG. 12A, there will be described an alternative to the measuring device 800 of the three-point contact type, which alternative is constructed by modifying the parallel-translation-type adjusting mechanism for the sensor II, which mechanism permits the measuring device 800 to be moved on the seating 24 in the parallel translation manner.

Figure 12B:
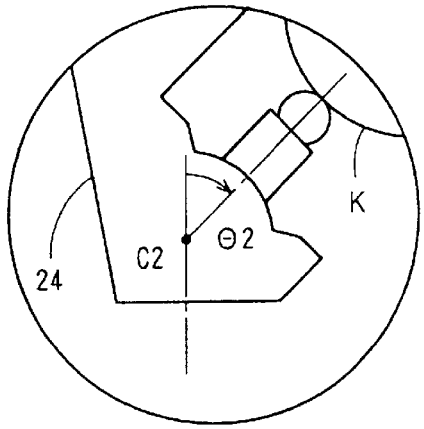
FIG. 12B is a front elevation view illustrating a portion of the measuring device 800 of FIG. 12A constructed in an alternative manner.
Figure 14:
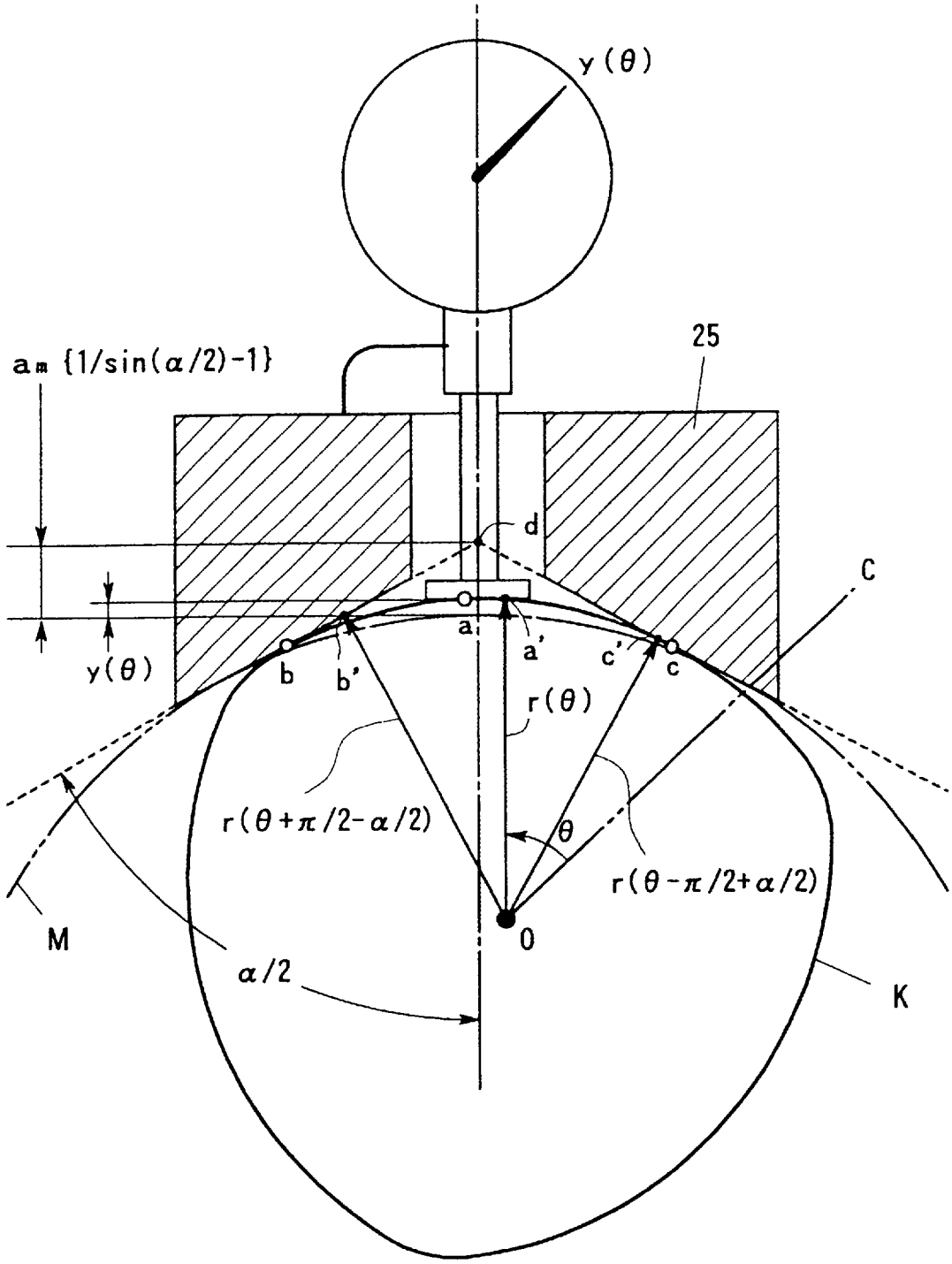
FIG. 14 is a view for explaining a method for measuring a circularity deviation in a three-point contact manner of a riding gauge type.
Figure 15:
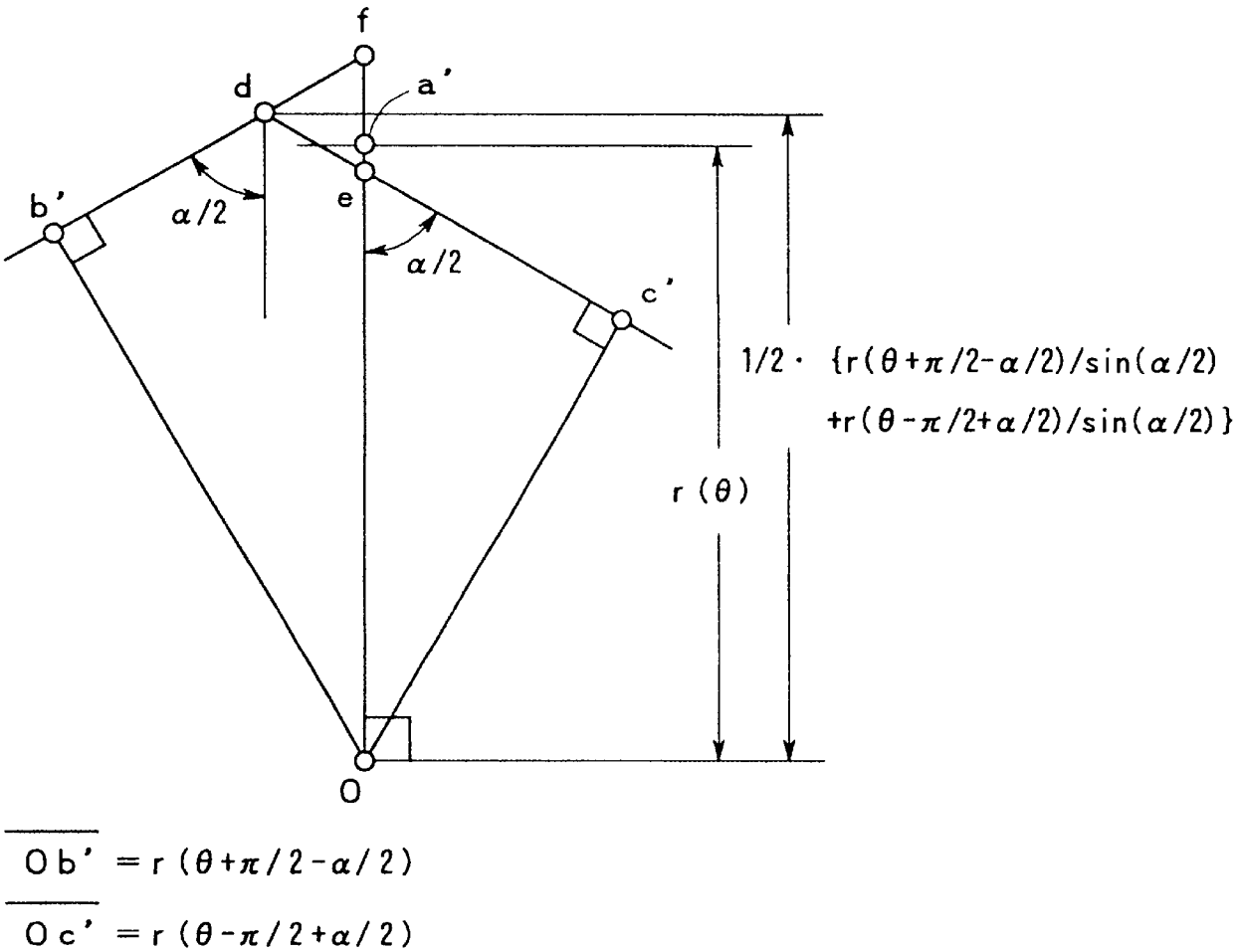
FIG. 15 is a view for explaining a method for measuring a circularity deviation in a three-point contact manner of a riding gauge type.

In the modified arrangement, the seating 24 incorporates a pivoting-type adjusting mechanism permitting the sensor II to be pivoted about a C2-axis (in FIG. 12B, indicated by the point C2). By operation of the pivoting-type adjusting mechanism, a position of a point of intersection of two straight lines representing two measuring directions for the respective sensors I, II, which point is located at or near the original point O, can be moved (i.e., adjusted) depending upon the average radius $a_0$ of a cylindrical object to be measured, like in the case of the parallel-translation-type adjusting mechanism.

The sensor II is pivoted about a point C2 shown in FIG. 12B, by operation of the aforementioned pivoting-type adjusting mechanism. In other words, an angle between a line passing the point C2 in parallel to the centerline of the V-block 25, as shown by the dash-dotted line in FIG. 12B, and a line representing the measuring direction of the sensor II is changed by operation of the pivoting-type adjusting mechanism. The angle is always equal to the angle $\Theta_2$ shown in FIG. 12A, which means a phase angle of the sensor II. Therefore, in this arrangement, each time the pivoting-type adjusting mechanism has changed the phase angle of the sensor II, it is required to calculate values of the magnifications listed in a row associated with "$\Theta$2" in the table of FIG. 13.

A center-of-cylinder adjusting means such as the above pivoting-type adjusting mechanism would achieve the same results as the measuring device 800 of the three-point contact type shown in FIG. 12A.

It is noted that the present invention may be practiced such that a correction of data indicative of a profile of a workpiece to be subjected to the true-circle machining operation is effected so that an amount of eccentricity "R" is eventually zeroed.

In other words, the present invention may be applied to a measurement or the true-circle machining operation of a workpiece such as a crank journal of a crankshaft supported by a machine rotatably about and coaxially with a rotation axis such as the C-axis.

Described more specifically, there can exist a case where a workpiece such as a crank journal supported by a machine rotatably about a rotation axis such as the C-axis has been deviated from the rotation axis, as not intended, due to a slight degree of machining error resulting from changes in rigidity or grinding force of the workpiece. By a correction of data indicative of a profile of a workpiece, in a manner such as a feedforward one, using the measurement of a position of an axis of the workpiece or the measurement of the circularity deviation of the workpiece, which measurement is performed according to the present invention, the thus supported workpiece can be subjected to the true-circle machining operation with a high degree of machining accuracy.

It will be appreciated by those skilled in the art that changes could be made to the embodiments described above without departing from the broad inventive concept thereof it is understood, therefore, that this invention is not limited to the particular embodiments disclosed, but it is intended to cover modifications within the spirit and scope of the present invention as defined by the appended claims.

What is claimed is:

1. An apparatus for measuring a circularity deviation of a cylinder of an object intended to be integrally rotated about a rotation axis, the cylinder being eccentric as either intended or not with the rotation axis, the apparatus comprising:

a first measuring device for measuring a circumferential surface of the cylinder at each measuring point "p" thereon in a three-point contact method;

a motion controlling mechanism for permitting the first measuring device to be moved along a circumference of the cylinder, which circumference lies on a cross section of the cylinder perpendicular to the rotation axis, in contact with the circumferential surface of the cylinder, during rotation of the cylinder about the rotation axis;

a circularity deviation calculating device for calculating the circularity deviation of the cylinder, on the basis of a relative position "x" of the rotation axis relative to the apparatus for measuring the circularity deviation, a rotating angle Ψ of the cylinder about the rotation axis, and an output "y" of the first measuring device, wherein the first measuring device includes a plurality of sensors each for measuring the cylinder, such that the plurality of sensors are arranged at different phase angles Θ about an original point O defined to be located at or near a center of the circumference of the cylinder.

2. The apparatus according to claim 1, wherein the object is a workpiece, a circumferential surface of which may be machined by a machine contacting a tool attached to a tool stand of the machine with the circumferential surface of the workpiece for machining, the measurement of the circularity deviation by the apparatus for measuring the circularity deviation may be performed without removal of the workpiece from the machine.

3. The apparatus according to claim 2, wherein the machine may move the cylinder and the tool stand relatively to each other in a feeding direction perpendicular to the rotation axis, thereby permitting the tool to follow the cylinder during rotation of the cylinder about the rotation axis, resulting in a change in the relative position "x".

4. The apparatus according to claim 1, wherein the circularity deviation calculating device comprises:

a second measuring device for measuring the relative position "x";

a third measuring device for measuring the rotating angle Ψ; and circularity deviation calculating means for calculating the circularity deviation, on the basis of the measured relative position "x" and rotating angle Ψ, and the output "y" of the first measuring device.

5. The apparatus according to claim 1, wherein the motion controlling mechanism is adapted to have a geometrical configuration permitting a relationship among the relative position "x", the rotating angle (Ψ, and an angle θ of the cylinder about an original point O defined to be located at or near a center of the cylinder, to be independent of a change in an attitude of the motion controlling mechanism, which attitude results from rotation of the cylinder.

6. The apparatus according to claim 5, wherein the motion controlling mechanism comprises:

a first arm coupled with an stationary member, pivotable about a first pivoting axis offset in parallel from the rotation axis;

a second arm coupled with a free end of the first arm, pivotable about a second pivoting axis offset in parallel from the rotation axis, the second arm carrying at a free end thereof the first measuring device.

7. The apparatus according to claim 6, wherein the second arm is configured to have a first sub-arm extending from the second pivoting axis, and a second sub-arm secured to the first sub-arm so as to form a predetermined fixed angle ζ therebetween, the second sub-arm carrying at a free end thereof the first measuring device.

8. An apparatus for measuring a circularity deviation of a cylinder of an object intended to be integrally rotated about a rotation axis, the cylinder being eccentric as either intended or not with the rotation axis, the apparatus comprising:

a first measuring device for measuring a circumferential surface of the cylinder at each measuring point "p" thereon in a three-point contact method;

a motion controlling mechanism for permitting the first measuring device to be moved along a circumference of the cylinder, which circumference lies on a cross section of the cylinder perpendicular to the rotation axis, in contact with the circumferential surface of the cylinder, during rotation of the cylinder about the rotation axis;

a circularity deviation calculating device for calculating the circularity deviation of the cylinder, on the basis of a relative position "x" of the rotation axis relative to the apparatus for measuring the circularity deviation, a rotating angle Ψ of the cylinder about the rotation axis, and an output "y" of the first measuring device, wherein the circularity deviation calculating device comprises first variable-transforming means for expressing a position of the each measuring point "p" on the circumferential surface of the cylinder according to a system of 2-dimensional polar coordinates formulated on a coordinate plane which is defined by an original point O predetermined to be located at or near a center of the circumference of the cylinder, and an original line OC predetermined to extend from the original point O and which is fixed to the circumference of the cylinder, using a distance "r" from the original point O and an angle θ relative to the original line OC, the circularity deviation calculating device further obtains the output "y" measured by the first measuring device at the each measuring point "p" in the form of a function y(θ) of the angle θ, by utilizing a first variable-transformation for transforming the relative position "x" and rotating angle Ψ obtained when the output "y" is measured by the first measuring device at the each measuring point "p", into the angle θ.

9. The apparatus according to claim 8, wherein the first variable-transformation is a variable-transformation "θ=f (Ψ, x, Λ)" for transforming the relative position "x" and rotating angle ψ obtained when the output "y" is measured by the first measuring device at the each measuring point "p", into the angle θ, by utilizing a predetermined group of parameters Λ for defining an attitude of the motion controlling mechanism.

10. The apparatus according to claim 9, wherein the predetermined group of parameters A includes at least one of a length of at least one of a plurality of constituents of the motion controlling mechanism, and a magnitude of at least one of angles, each of which is formed between ones of the plurality of constituents adjacent to each other.

11. The apparatus according to claim 9, wherein the motion controlling mechanism comprises:

a first arm coupled with an stationary member, pivotable about a first pivoting axis offset in parallel from the rotation axis;

a second arm coupled with a free end of the first arm, pivotable about a second pivoting axis offset in parallel from the rotation axis, the second arm configured to have a first sub-arm extending from the second pivoting axis; and a second sub-arm secured to the first sub-arm so as to form a predetermined fixed angle ζ therebetween, the second sub-arm carrying at a free end thereof the first measuring device, the predetermined group of parameters Λ includes at least one of a deviation "D" of the first pivoting axis from a reference axis of the stationary member in a horizontal direction; a height "H" of the first pivoting axis from the reference line; a radius "R" of a circular locus followed by the center of the cylinder during rotation thereof about the rotation axis; a length "$L_1$" of the first arm; a length "$L_{21}$" of the first sub-arm; a length "$L_{22}$" of the second sub-arm; and the predetermined fixed angle ζ.

12. The apparatus according to claim 11, wherein the object is a workpiece, a circumferential surface of which is to be machined by a machine, the machine is a cylindrical grinding machine grinding the circumferential surface of the workpiece by contacting a tool attached to a tool stand of the cylindrical grinding machine, with the circumferential surface of the cylinder while rotating the tool about the rotation axis "W", the tool stand functioning as the stationary member, the rotation axis "W" functioning as the reference axis of the stationary member.

13. The apparatus according to claim 8, wherein the circularity deviation calculating device further comprises:

distance obtaining means for obtaining from the function y(θ), by utilizing harmonic analysis, the distance "r" from the original point O, of the each measuring point "p" on the circumferential surface of the cylinder, in the form of a function r(θ) of the angle θ;

second variable-transforming means for transforming the function r(θ) into a function r(Ψ) of the rotating angle Ψ, using a second variable-transformation for transforming the angle θ and relative position "x" obtained at the each measuring point "p", into the rotating angle Ψ; and compensatory amount obtaining means for obtaining an amount δx by which the relative position "x" is to be compensated for permitting the function r(Ψ) to become closer to a target radius $a_m$ of the cylinder as a result of machining of the circumferential surface of the cylinder, in the form of a function δx(Ψ) of the rotating angle θ.

14. The apparatus according to claim 13, wherein the second variable-transformation is regarded as an inverse-transformation of the first variable-transformation in terms of a relationship between the rotating angle ψ and angle θ.

15. The apparatus according to claim 1, wherein the first measuring device includes a plurality of measuring members, each measuring member intended to be in contact with the circumferential surface of the cylinder on two contact surfaces of the each measuring member, the two contact surfaces of the each measuring member being opposed to each other with an opposing angle α therebetween, which angle α is unequal to 180 degrees and which is different from opposing angles a of other ones of the plurality of measuring members.

16. The apparatus according to claim 15, wherein the plurality of measuring members are arranged in a common plane bisecting the opposing angles α of the plurality of measuring members, the first measuring device further includes a sensor to be used commonly with the plurality of measuring members, which sensor measures the cylinder in one measuring direction on the common plane.

17. The apparatus according to claim 1, wherein at least one of the plurality of sensors includes an adjusting mechanism for permitting a position or an orientation of the measuring direction of the at least one sensor to be changed on the basis of an average radius $a_0$ of the cylinder, thereby enabling an adjustment in a position of a point of intersection of a plurality of lines extending from the respective sensors in the corresponding measuring directions.

18. The apparatus according to claim 1, further comprising:

a motion sensor for detecting a motion parameter ξ related to a mechanical motion of the motion controlling mechanism; and parameter correcting means for correcting at least one of constants belonging to the predetermined group of parameters A, which constant is necessary to be considered for replacement, repair or adjustment of the first measuring device, the correction being effected on the basis of a target radius $a_m$ of the cylinder, and the motion parameter ξ detected by the motion sensor in a state where a gauge cylinder is contacted with the first measuring device, an actual radius of the gauge cylinder not being eccentric with the rotation axis, which actual radius is equal to the target radius $a_m$.

19. An apparatus for measuring a circularity deviation of a cylinder of an object intended to be integrally rotated about a rotation axis, the cylinder being eccentric as either intended or not with the rotation axis, the apparatus comprising:

a first measuring device for measuring a circumferential surface of the cylinder at each measuring point "p" thereon in a three-point contact method;

a motion controlling mechanism for permitting the first measuring device to be moved along a circumference of the cylinder, which circumference lies on a cross section of the cylinder perpendicular to the rotation axis, in contact with the circumferential surface of the cylinder, during rotation of the cylinder about the rotation axis;

a circularity deviation calculating device for calculating the circularity deviation of the cylinder, on the basis of a relative position "x" of the rotation axis relative to the apparatus for measuring the circularity deviation, a rotating angle Ψ of the cylinder about the rotation axis, and an output "y" of the first measuring device;

a motion sensor for detecting a motion parameter ξ related to a mechanical motion of the motion controlling mechanism; and original point position measuring means for measuring a position of an original point O defined to be fixedly located at or near a center of the cylinder, which position is defined relative to the rotation axis, on the basis of the relative position "x" or a value related thereto, the rotating angle Ψ or a value related thereto, and the motion parameter ξ or a value related thereto.

20. The apparatus according to claim 20, wherein the motion sensor includes at least one of a pivoting angle sensor for detecting a pivoting angle of an arm of the motion controlling mechanism, which arm functions to produce the mechanical motion of the motion controlling mechanism by a pivoting motion of the arm, and an arm length sensor for detecting a length of the arm.

21. The apparatus according to claim 8, wherein the object is a workpiece, a circumferential surface of which may be machined by a machine contacting a tool attached to a tool stand of the machine with the circumferential surface of the workpiece for machining, the measurement of the circularity deviation by the apparatus for measuring the circularity deviation may be performed without removal of the workpiece from the machine.

22. The apparatus according to claim 21, wherein the machine may move the cylinder and the tool stand relatively to each other in a feeding direction perpendicular to the rotation axis, thereby permitting the tool to follow the cylinder during rotation of the cylinder about the rotation axis, resulting in a change in the relative position "x".

23. The apparatus according to claim 8, wherein the motion controlling mechanism is adapted to have a geometrical configuration permitting a relationship among the relative position "x", the rotating angle (Ψ, and an angle θ of the cylinder about an original point O defined to be located at or near a center of the cylinder, to be independent of a change in an attitude of the motion controlling mechanism, which attitude results from rotation of the cylinder.

24. The apparatus according to claim 23 wherein the motion controlling mechanism comprises:

a first arm coupled with an stationary member, pivotable about a first pivoting axis offset in parallel from the rotation axis;

a second arm coupled with a free end of the first arm, pivotable about a second pivoting axis offset in parallel from the rotation axis, the second arm carrying at a free end thereof the first measuring device.

25. The apparatus according to claim 24, wherein the second arm is configured to have a first sub-arm extending from the second pivoting axis, and a second sub-arm secured to the first sub-arm so as to form a predetermined fixed angle ζ therebetween, the second sub-arm carrying at a free end thereof the first measuring device.

* * * * *